US011111643B2

(12) United States Patent
Bergman

(10) Patent No.: US 11,111,643 B2
(45) Date of Patent: Sep. 7, 2021

(54) BI-DIRECTIONAL SNOW REMOVAL MACHINE

(71) Applicant: Ronald H. Bergman, Mentor, MN (US)

(72) Inventor: Ronald H. Bergman, Mentor, MN (US)

( * ) Notice: Subject to any disclaimer, the term of this patent is extended or adjusted under 35 U.S.C. 154(b) by 236 days.

(21) Appl. No.: 16/381,769

(22) Filed: Apr. 11, 2019

(65) Prior Publication Data

US 2019/0316308 A1 Oct. 17, 2019

Related U.S. Application Data

(60) Provisional application No. 62/657,143, filed on Apr. 13, 2018.

(51) Int. Cl.
*E01H 5/00* (2006.01)
*E01H 5/09* (2006.01)

(52) U.S. Cl.
CPC ..... *E01H 5/098* (2013.01)

(58) Field of Classification Search
CPC ..... E01H 5/061; E01H 5/068; E01H 5/07; E01H 5/098
USPC ..... 37/264, 266, 267
See application file for complete search history.

(56) References Cited

U.S. PATENT DOCUMENTS

| | | | | |
|---|---|---|---|---|
| 2,979,215 | A * | 4/1961 | Brisson | E02F 3/342 414/553 |
| 6,314,666 | B1 * | 11/2001 | Klemenhagen | E01H 5/06 172/815 |
| 7,412,787 | B2 * | 8/2008 | Sutton | E01H 5/061 37/267 |
| 8,191,288 | B2 * | 6/2012 | Weagley | E01H 5/06 37/267 |
| 9,556,572 | B2 | 1/2017 | Duchscherer et al. | |
| 9,598,829 | B2 * | 3/2017 | Betts | E01H 5/098 |
| 9,629,299 | B2 * | 4/2017 | Swanson | E02F 3/7631 |
| 9,863,107 | B2 | 1/2018 | Friberg et al. | |
| 9,885,160 | B1 * | 2/2018 | Stone | E01H 5/065 |
| 2008/0078107 | A1 * | 4/2008 | Forsythe | E02F 3/8152 37/231 |
| 2015/0275447 | A1 * | 10/2015 | Mondul | E01H 5/045 37/197 |

FOREIGN PATENT DOCUMENTS

| | | |
|---|---|---|
| CA | 2240436 C | 5/2000 |
| CA | 2371704 C | 7/2003 |

* cited by examiner

*Primary Examiner* — Gary S Hartmann
(74) *Attorney, Agent, or Firm* — Fredrikson & Byron, P.A.

(57) ABSTRACT

A bi-directional snow blower includes a frame coupled to a suspension mechanism of a motorized vehicle. A scraper blade may be rigidly and non-pivotally coupled to the frame, to move the scraper blade together with the frame and orient the scraper blade into a range of positions, including a raised position, a first lowered position and a second lowered position. The bi-directional snow blower may remove particulate from the floor surface when the vehicle is traveling in a forward direction and in a reverse direction opposite to the forward direction.

13 Claims, 25 Drawing Sheets

BI-DIRECTIONAL SNOW REMOVAL MACHINE

RELATED APPLICATIONS

This application claims the benefit of U.S. Provisional Application No. 62/657,143 filed Apr. 13, 2018, the entire contents of which is incorporated herein by reference.

BACKGROUND

Snow removal machines such as snow blowers typically include a snow scraper blade attached to a motorized vehicle such as a skid-steer loader. The scraper blade can move relative to the motorized vehicle between a transport position and an operating position. In the operating position, the snow scraper can remove snow from the ground and direct it toward an auger. A chute may be positioned in operative communication with an auger housing that encloses the auger such that snow directed toward the auger is sent into the chute and is directed away from the motorized vehicle, thereby removing snow from a floor surface (e.g., road, driveway, sidewalk, alley, and the like).

Typically, such machines may remove snow while the motorized vehicle is moving in a single (e.g., forward) direction. While some snow removal machines may remove snow while moving the forward as well as rearward directions, they may include many complex moving parts and may therefore be expensive to manufacture and/or difficult to operate.

SUMMARY

The bi-directional snow blower according to embodiments of the present disclosure can be removably coupled to a motorized vehicle and can remove snow when the motorized vehicle is moving in a forward direction as well as a reverse direction (which is opposite to the forward direction). The forward and reverse directions can correspond to directions of travel relative to a transverse center plane of the vehicle. While certain embodiments illustrate removal of snow, any particulate matter (dirt, debris, etc.) may be removed in other embodiments.

In certain exemplary embodiments, the snow blower includes a frame coupled to a suspension mechanism of the vehicle, and a scraper blade rigidly coupled to one or more surfaces of the snow blower.

In optional aspects of the present disclosure, the coupling between the frame and the scraper blade may be non-pivotal. Accordingly, when it is desired to raise or lower the scraper blade, the suspension mechanism may raise or lower the snow blower frame, and the scraper blade may be lifted or lowered along with the snow blower frame.

In optional aspects of the present disclosure, the scraper blade can be pivotally moved into one or more positions by the suspension mechanism. In an example, the scraper blade can be moved between a first lowered position, a second lowered position and a raised position. Optionally, the suspension mechanism can provide a range of motions (e.g., vertical lift and lower, and rotational pivoting) to adjust the scraper blade to various heights and/or angles relative to the floor surface.

In some embodiments, at least one of the first lowered position and the second lowered position can correspond to various angles of pivoting of the scraper blade relative to the floor surface. Any such angles of pivoting are possible. In some further optional embodiments, various surfaces of the scraper blade can be arranged such that the scraper blade can be lowered to the first and second lowered positions to more effectively scrape snow during both forward and reverse directions of movement of the motorized vehicle.

In still further embodiments, the range of movements provided by the motorized vehicle can be combined to achieve different heights to which the scraper blade can be positioned and/or rotated about the pivot axis.

In some embodiments, the snow blower includes a chute that can have an outlet to direct snow away from the snow blower.

In optional advantageous embodiments of the present disclosure, the chute can be rotatable relative to the scraping blade and/or the frame of the snow blower. Such embodiments may facilitate removing snow from surfaces that are in close proximity to exterior vertical surfaces such as walls, doors, siding and the like.

According to optional advantageous embodiments, the chute can be positioned to the rear of the scraper blade such that when the scraper blade is lowered, portions of the chute may be protected and/or prevented from abutting any vertical surfaces that may be in the path of snow removal.

In optional advantageous embodiments, the vehicle can be positioned as close as possible to an exterior vertical surface (e.g., a siding, door, or an exterior wall) without physically contacting the vertical surface when traveling in the forward direction. At this position, the scraper blade can be pivoted to a desired angle, and the vehicle operated in reverse direction to remove snow that has accumulated in close proximity to the exterior vertical surface.

BRIEF DESCRIPTION OF DRAWINGS

Unless otherwise indicated.

FIG. 8 is a side perspective view of a bi-directional snow blower lowered in the second lowered position according to another non-limiting embodiment of the present disclosure with dimensions generally illustrated to scale (in inches);

FIG. 9 is an enlarged side view of the bi-directional snow blower of FIG. 8 lowered in the second lowered position with angles generally illustrated to scale (in degrees);

FIG. 10 is a back perspective view of the bi-directional snow blower of FIG. 8 lowered in the first lowered position with angles and/or dimensions generally illustrated to scale (in inches);

FIG. 11 is a front perspective view of the bi-directional snow blower of FIG. 8 lowered in the first lowered position with angles and/or dimensions generally illustrated to scale (in inches);

FIG. 12 is a side perspective view of the bi-directional snow blower of FIG. 8 lowered in the first lowered position with angles and/or dimensions generally illustrated to scale (in inches);

FIG. 13 is another side perspective view of the bi-directional snow blower of FIG. 8 lowered in the first lowered position with angles and/or dimensions generally illustrated to scale (in inches);

FIGS. 22 and 23 illustrate details of a blower assembly of a bi-directional snow blower according to any of the disclosed embodiments;

DETAILED DESCRIPTION

Embodiments of the present disclosure provide a bi-directional snow blower 10 that can reduce the time taken to clear snow from surfaces such as roads, pavements, sidewalks, alleys, driveways, and the like, by permitting snow removal while traveling in a forward and an opposite, reverse direction 44 unlike conventional snow blowers.

Figure 1:
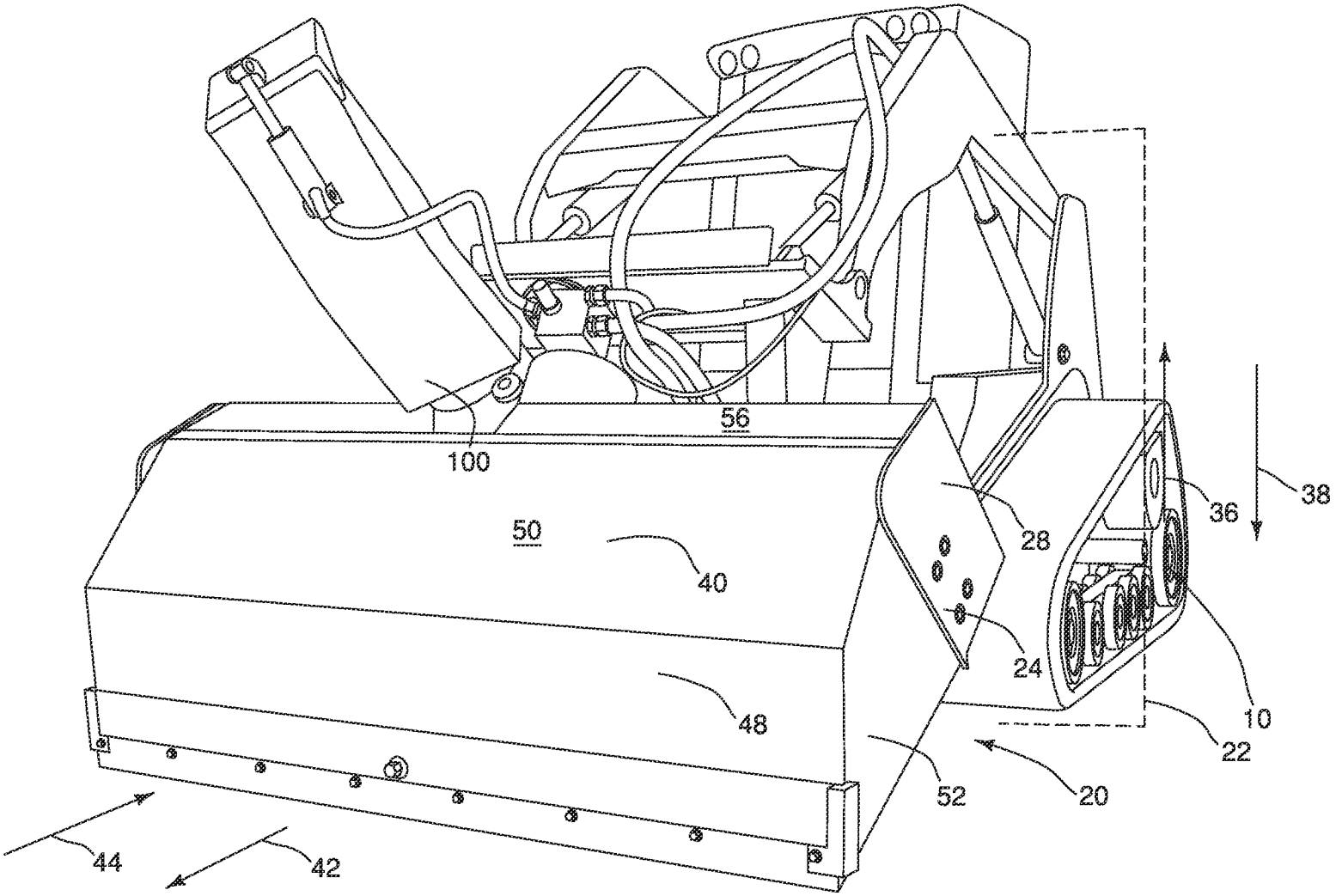
FIG. 1 is a front perspective view of a motorized vehicle with a bi-directional snow blower, with the snow blower lowered in the second lowered position according to a non-limiting embodiment of the present disclosure.
Figure 2A:
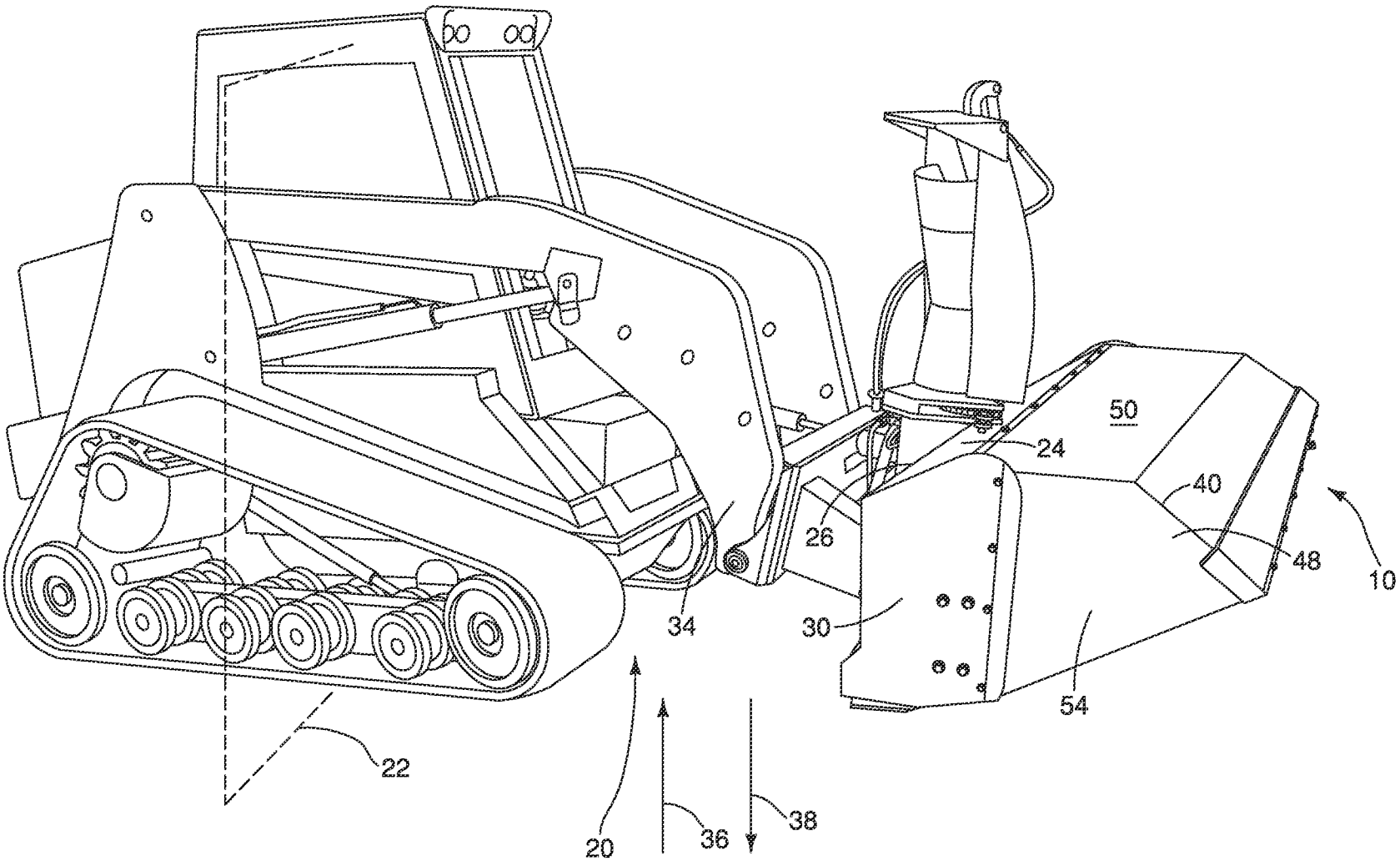
FIG. 2A is a side perspective view of the motorized vehicle with the bi-directional snow blower of FIG. 1, with the snow blower lowered in the first lowered position.
Figure 2B:
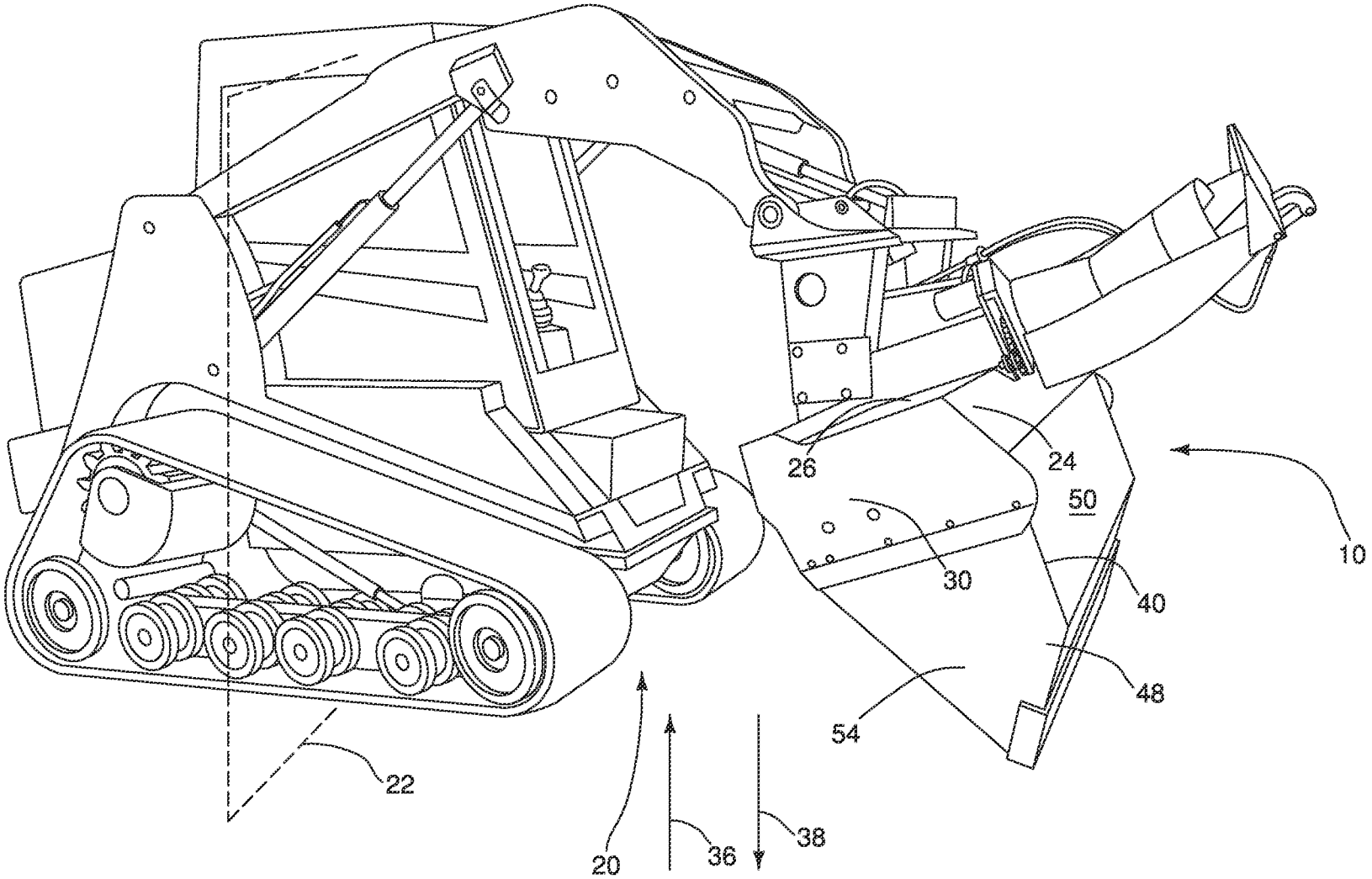
FIG. 2B is a side perspective view of the motorized vehicle with the bi-directional snow blower of FIG. 1, with the snow blower lowered in the second lowered position.
Figure 3:
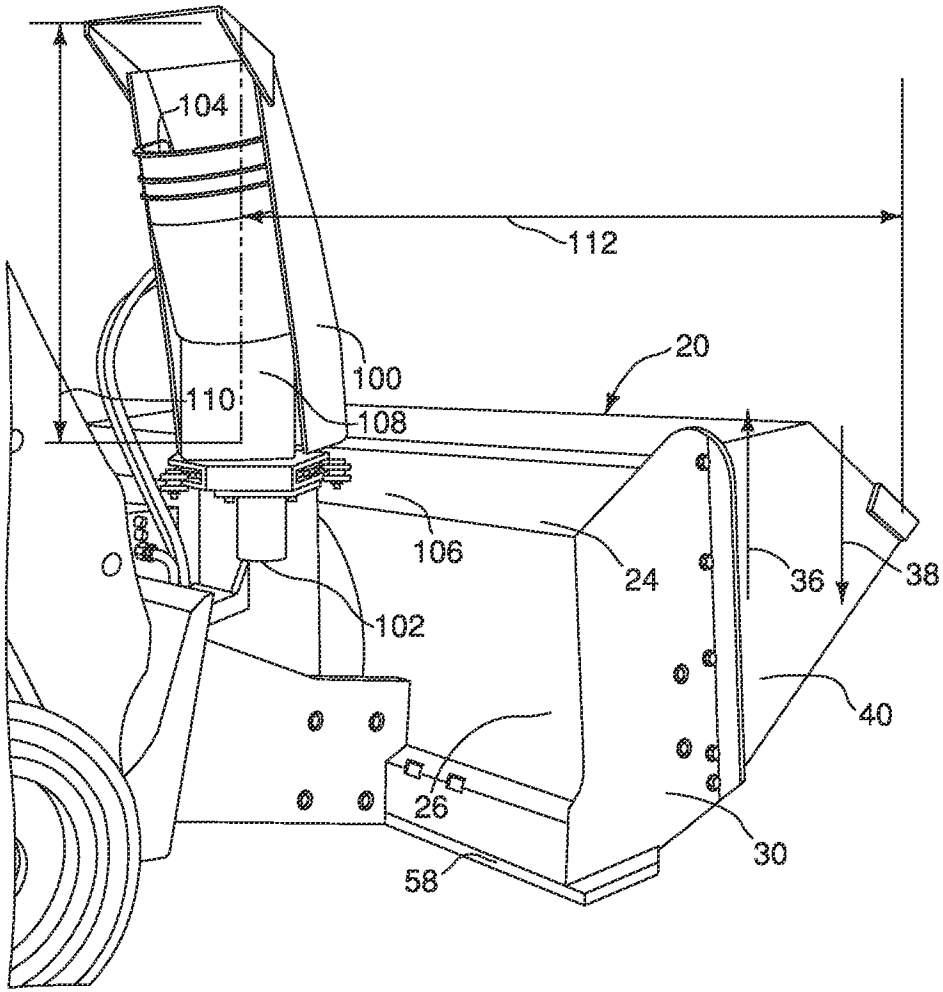
FIG. 3 is a partial side perspective view of the motorized vehicle with the bi-directional snow blower of FIG. 1, with the snow blower lowered in the first lowered position.

FIGS. 1-3 illustrate various views of a bi-directional snow blower 10 according to an embodiment. The bi-directional snow blower 10 according to embodiments of the present disclosure can be removably coupled to a motorized vehicle 20. In some embodiments, the motorized vehicle 20 can be a skid-steer loader, a tractor, a truck, or the like. Alternatively, the snow blower according to some of the disclosed embodiments may also be incorporated into a walk-behind snow blower and/or be a self-propelled snow blower integrated into a vehicle 20. The vehicle 20 can be driven by an operator or operated autonomously. Components of the motorized vehicle 20, such as a mobile body, wheels, an engine or battery-powered or hydraulic motors to propel the vehicle 20 and associated components are generally well-known and are therefore omitted for brevity.

According to certain embodiments, the snow blower can remove snow when the motorized vehicle 20 is moving in a forward direction 42 as well as a reverse direction 44. Appreciably, the reverse direction 44 is opposite to the forward direction 42. The forward and reverse directions can correspond to directions of travel relative to a transverse center plane 22 of the vehicle 20, as shown in FIGS. 1 and 2.

In certain exemplary embodiments, the snow blower includes a frame 24 coupled (e.g., detachably) to the motorized vehicle 20. The frame 24 can have a back surface 26, a first side surface 28 and a second side surface 30. The back surface 26 can extend between the first side surface and the second side surface, and can be generally non-coplanar with the first side surface and the second side surface. The first side surface can also be opposite to the second side surface. The frame 24 can be generally open to the front in the embodiment where the snow blower is attached to the front of the vehicle 20. Alternatively, the frame 24 can be open to the rear where the snow blower is attached to the rear of the vehicle 20. Accordingly, the frame 24 thus includes at least one open side.

The back surface 26 of the frame 24 can be operatively coupled to a suspension mechanism of the motorized vehicle 20 for raising and/or lowering at least certain components of the snow blower. The suspension mechanism can include at least a pair of lift arms 34. In the illustrated embodiments, the lift arms 34 extend outwardly from a front portion (e.g., relative to the transverse center plane 22) of the vehicle 20. Alternatively, the vehicle 20 can be rear-loaded, and in such embodiments, the lift arms 34 may extend outwardly from a rear portion (e.g., relative to the transverse center plane 22) of the vehicle 20.

The lift arms 34 may raise or lower the frame 24 of the snow blower along directions 36, 38 respectively, according to known methods. For example, the suspension mechanism may include one or more linear actuators, which may be coupled (e.g., by coupling structures such as brackets, linkages and the like) such that when the linear actuator is extended or retracted, the frame 24 of the snow blower may be raised or lowered respectively (or vice versa).

The snow blower according to some embodiments comprises a scraper blade 40. The scraper blade 40 can be rigidly coupled to one or more of the side surfaces 28, 30 and back surface 26 of the frame 24 of the snow blower (e.g., by fasteners such as bolts, rivets, and the like, or welded thereto). In certain advantageous aspects, the coupling between the frame 24 of the snow blower and the scraper blade 40 may be non-pivotal (e.g., non-rotational). Accordingly, when it is desired to raise or lower the scraper blade 40 (as will be described further below), the lift arms 34 may raise or lower the snow blower frame 24, and the scraper blade 40 may be lifted or lowered along with the snow blower frame 24 along directions 36, 38 respectively. Advantageously, such non-pivotal (e.g., non-rotational) coupling between the scraper blade 40 and the snow blower frame 24 may substantially simplify the construction of the snow blower, may make the snow-blower light-weight, and/or may be easier (and/or less expensive) to operate relative to conventional snow blowers.

Figure 4:
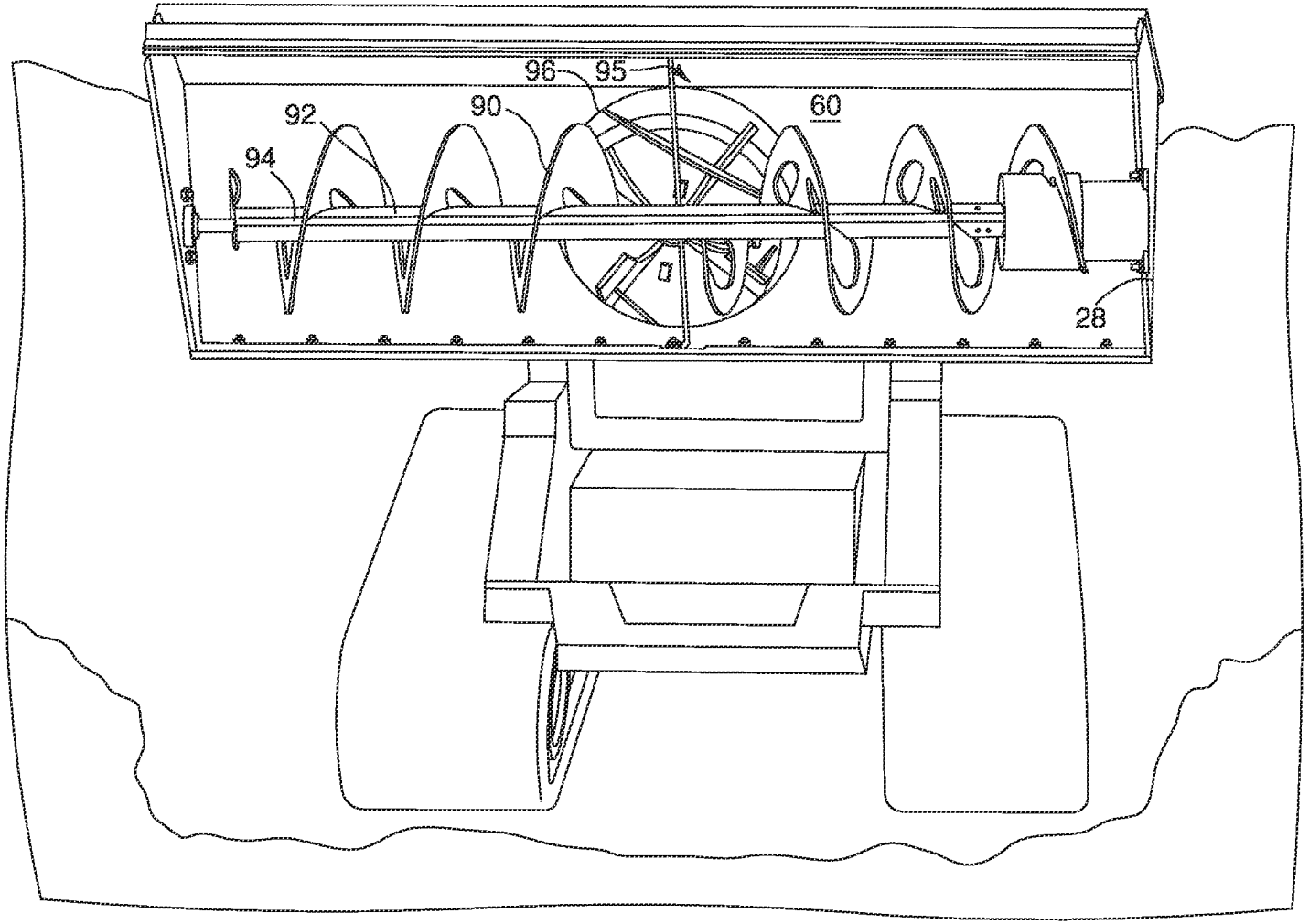
FIG. 4 is a front perspective view of the motorized vehicle with the bi-directional snow blower of FIG. 1, with the snow blower raised in a raised position.

The scraper blade 40 can be pivotally moved into one or more positions by the suspension mechanism. In an example, the scraper blade 40 can be moved between a first lowered position, a second lowered position and a raised position. FIGS. 2A and 3 illustrates the scraper blade 40 in the first lowered position. FIGS. 1 and 2B illustrates the scraper blade 40 in the second lowered position. FIG. 4 illustrates the scraper blade 40 in the raised position.

The suspension mechanism may include components (e.g., lift arms 34) that can raise the scraper blade 40 to the raised position (positioned at a desired height above the floor surface), and lower the scraper blade 40 so as to be closer to the floor surface. The suspension mechanism can also include coupling structures (e.g., brackets, linear actuator and the like), that can pivot the scraper blade 40 (and the frame 24) about a pivot axis 72. Cooperative movement of components of the suspension mechanism to move the scraper blade 40 between raised, first lowered and second lowered positions can be well understood from FIGS. 1-4. While these Figures illustrate a skid steer loader, any vehicle 20 that provides such range of motions can be used in the alternative.

In some embodiments, at least one of the first lowered position and the second lowered position can correspond to the position of the scraper blade 40 during operation (for instance, removing snow). Advantageously, the first lowered position can correspond to the position of the scraper blade 40 when removing snow during a forward direction 42 of travel of the machine. The second lowered position can correspond to the position of the scraper blade 40 when removing snow during a reverse direction 44 of travel of the machine. The raised position can correspond to the position of the scraper blade 40 when the snow blower does not remove snow, but is instead transported from one location to another.

Figure 5:
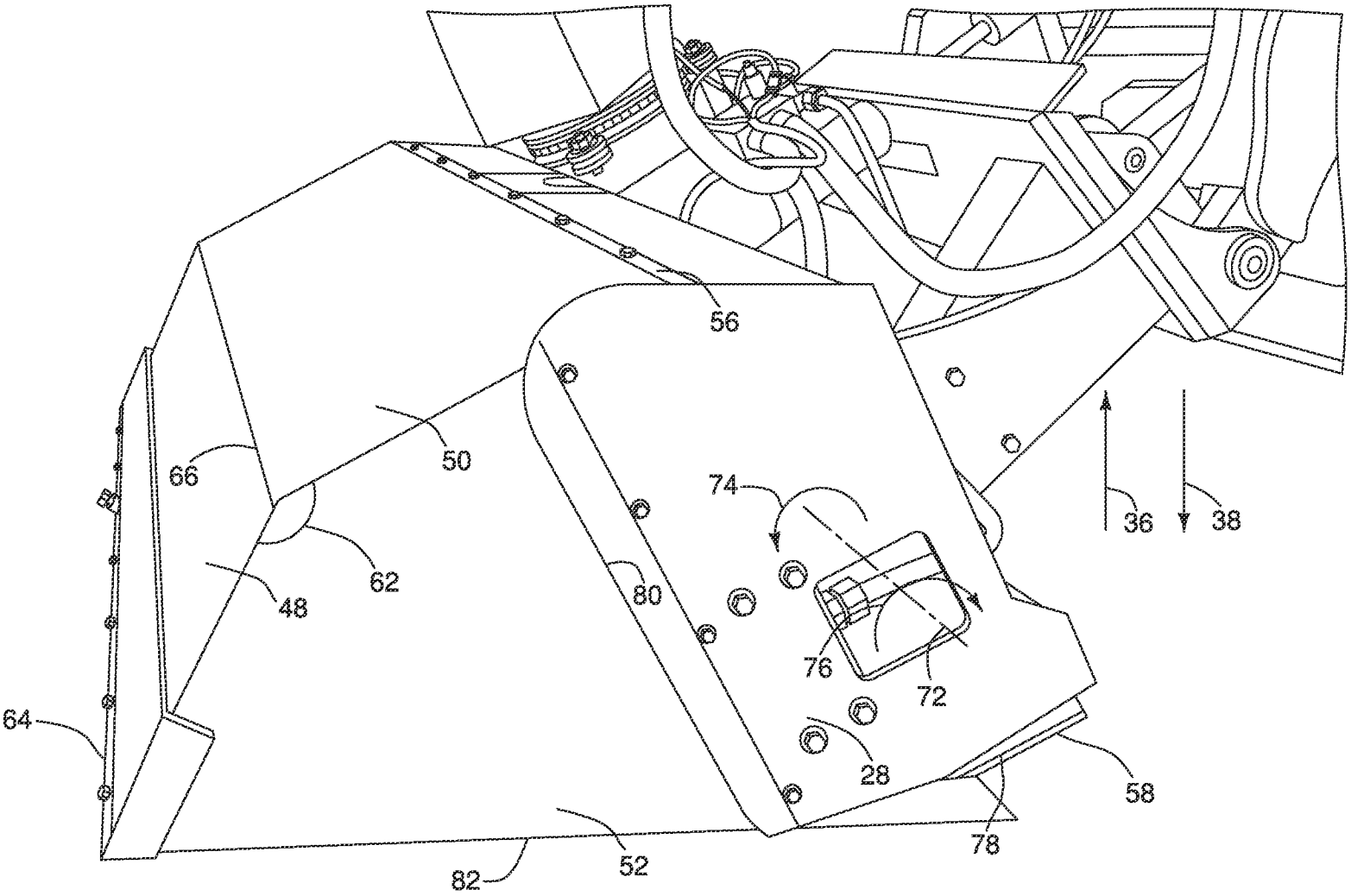
FIG. 5 is a side perspective view of a bi-directional snow blower lowered in the second lowered position according to a non-limiting embodiment of the present disclosure.

Referring now to FIGS. 1, 2 and 5, in certain aspects of the present disclosure, the scraper blade 40 can include a front surface 48, a top surface 50, a pair of opposite side surfaces 52, 54, an top rear surface 56 and a bottom surface 58. The surfaces can be arranged such that the scraper blade 40 includes an enclosure 60 that has at least one side open to the floor surface from which snow is to be removed. In the illustrated embodiment, a first side surface 52 of the scraper blade 40 is generally coplanar with a first side surface 28 of the frame 24 of the snow blower. A second side surface 54 of the scraper blade 40 is generally coplanar with a second side surface 30 of the frame 24 of the snow blower. The front surface 48, the top surface 50 and the top rear and bottom surfaces 56, 58 can each extend between the first side surface and the second side surface of the scraper blade 40.

With continued reference to FIGS. 1, 2 and 5, in certain embodiments, the scraper blade 40 can be attached to the frame 24 via one or more of the first and second side surfaces 28, 30 and/or back surface 26 of the frame 24. In the illustrated embodiment, the side surfaces 28, 30 and the back surface 26 of the frame 24 includes fasteners (e.g., bolts, nuts, rivets, and the like) that fasten the top rear and bottom surfaces 58 of the scraper blade 40 to the back surface 26 of the frame 24, and the side surfaces 52, 54 of the scraper blade 40 to the side surfaces 28, 30 of the frame 24. Alternatively, the scraper blade 40 can be welded to the frame 24. The coupling between the frame 24 and the scraper blade 40 can, in some embodiments, restrict (and/or prevent) the scraper blade 40 from moving (e.g., pivoting or sliding) relative to the frame 24 of the snow blower.

In some embodiments, various surfaces of the scraper blade 40 can be arranged such that the scraper blade 40 can be lowered to the first and second lowered positions to more effectively scrape snow during both forward and reverse directions of movement of the motorized vehicle 20. In one embodiment, as illustrated in FIGS. 2B and 5, the front surface 48 and the top surface 50 are each generally non-coplanar with each of the first side surface 52 and the second side surface 54. The front surface 48 is also generally non-coplanar with the top rear and bottom surfaces 56, 58 of the scraper blade 40 (and/or the back surface 26 of the frame 24). At least portions of the top surface 50 can also be non-coplanar with the top rear and bottom surfaces 56, 58 of the scraper blade 40 (and/or the back surface 26 of the frame 24). Further, portions of the top surface 50 can also be non-coplanar with the front surface 48. Accordingly, the top surface 50 can extend between the top rear surface 56 of the scraper blade 40 and the front surface 48.

The front surface 48 and the top surface 50 can form an angle 62 therebetween that can advantageously reduce the risk of portions of the snow blower from abutment with exterior surfaces (e.g., walls, siding, doors, etc., as best seen in FIGS. 17-20.). In advantageous aspects, returning to FIGS. 1, 2B and 5, the front surface 48 can form an angle of greater than 90 degrees (e.g., between about 95 degrees and about 170 degrees) with respect to the top surface 50. Such angular relationships can position the front surface 48 further away from the back surface 26 of the frame 24 (and/or top rear and bottom surfaces 56, 58 of the scraper blade 40) to protect components of the snow blower positioned to the rear of the front surface 48.

Figure 6:
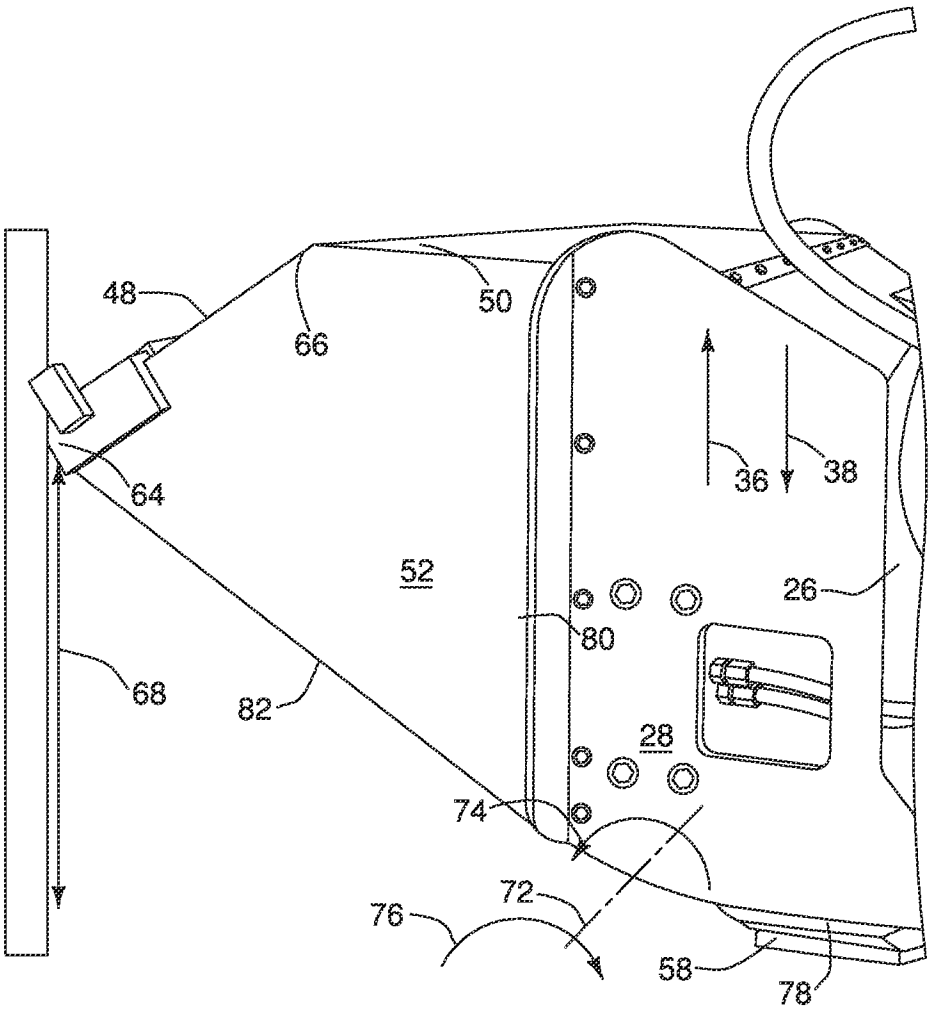
FIG. 6 is a side perspective view of the bi-directional snow blower of FIG. 5 lowered in the first lowered position.
Figure 7:
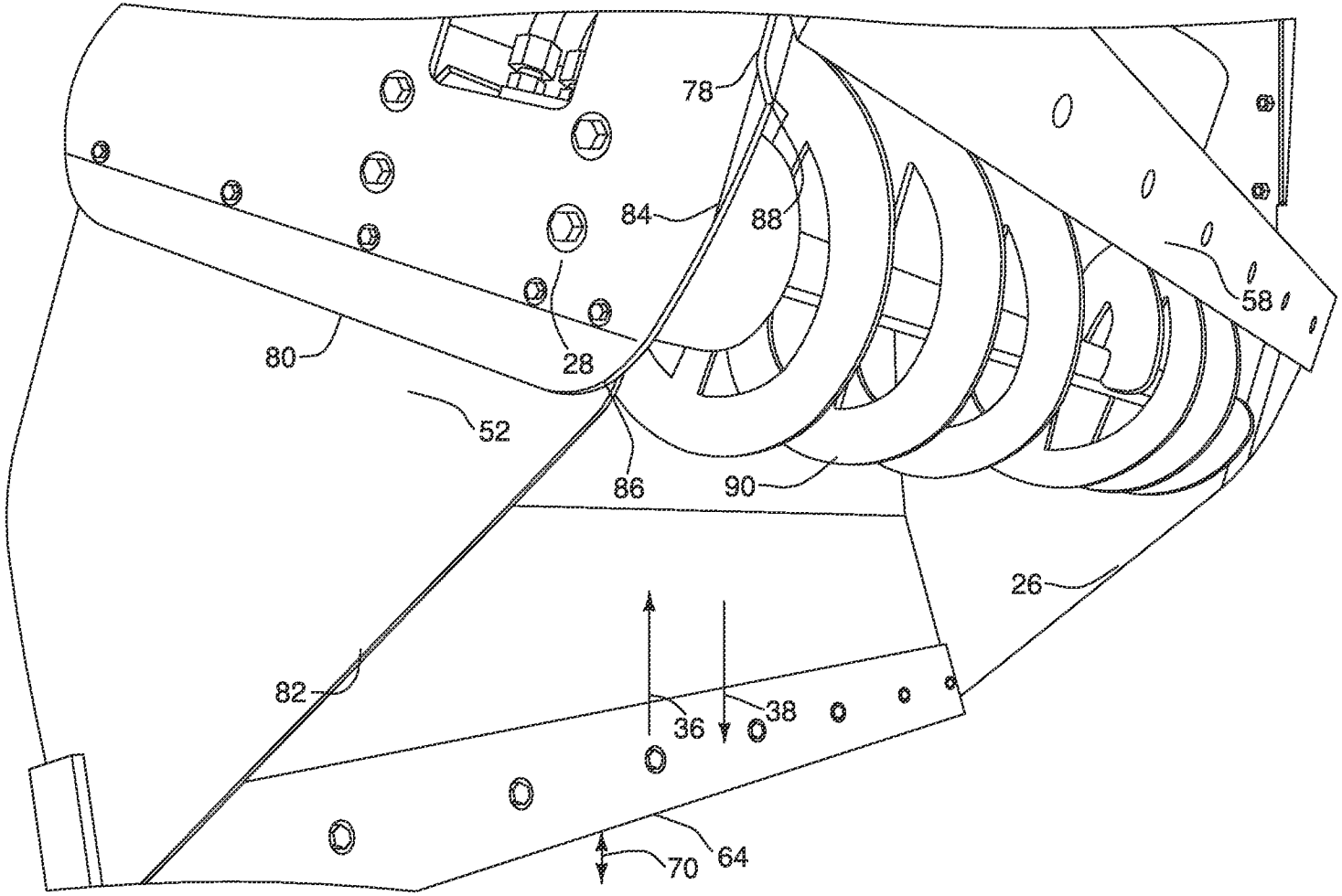
FIG. 7 is a side perspective view of the bi-directional snow blower lowered in another second lowered position with the lower rear surface raised by the lift arms after the scraper blade has been pivoted to the second lowered position.
Figure 9:
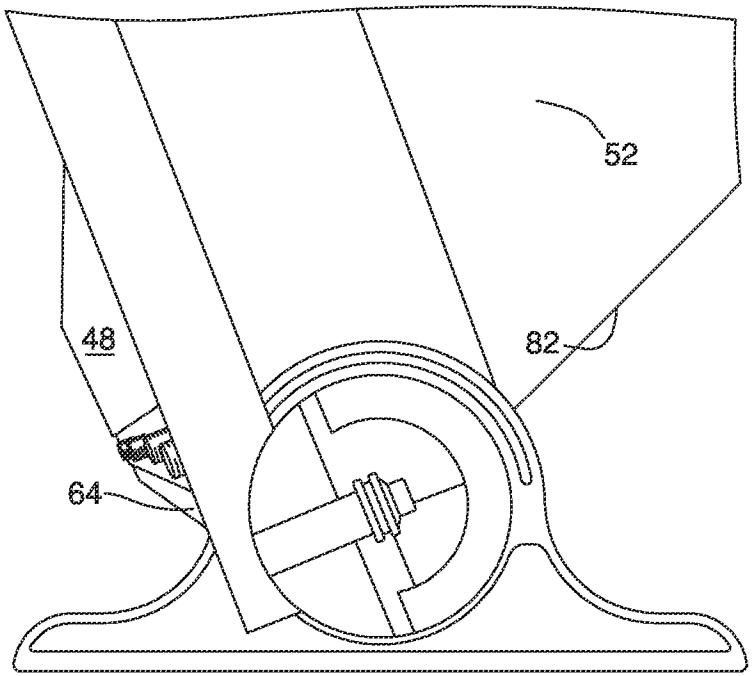
FIGS. 8-13 are generally illustrated to scale (in inches and/or degrees) to show dimensions and angular relationships of various components of the snow blower. The remaining figures may or may not be to scale.
Figure 8:
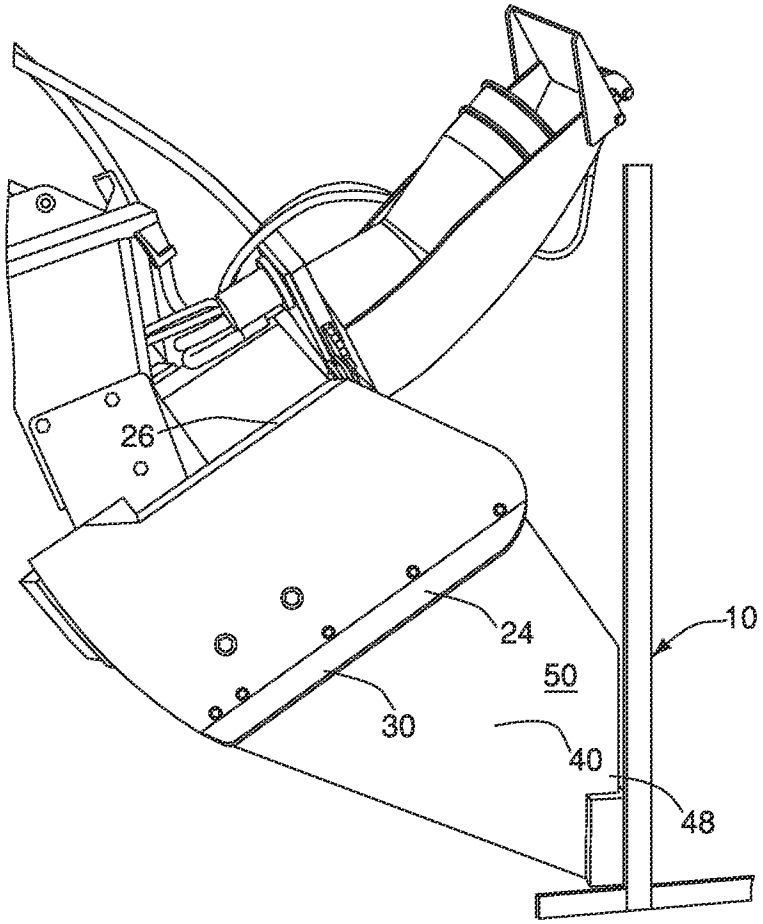
Figure 10:
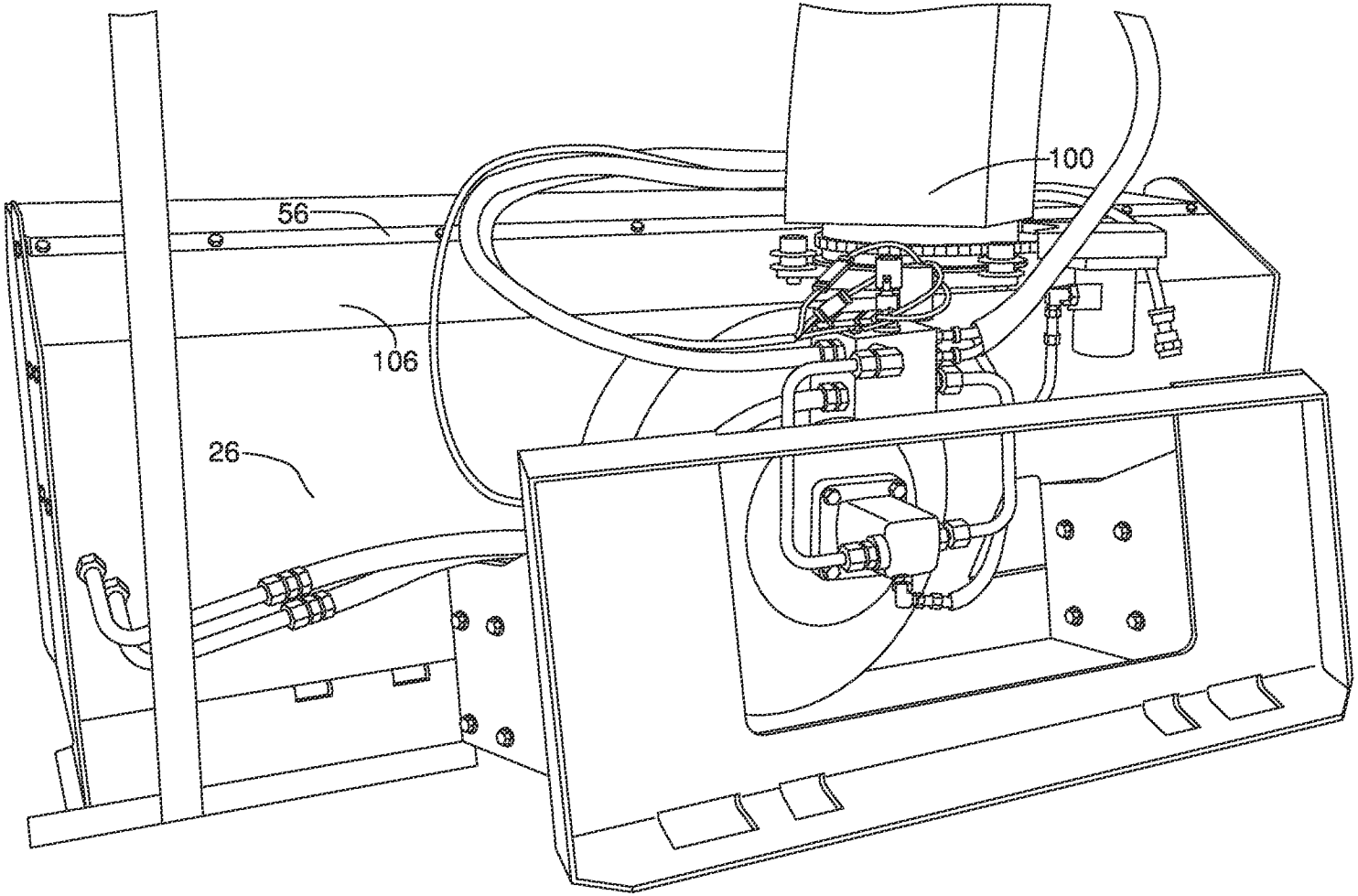
Figure 11:
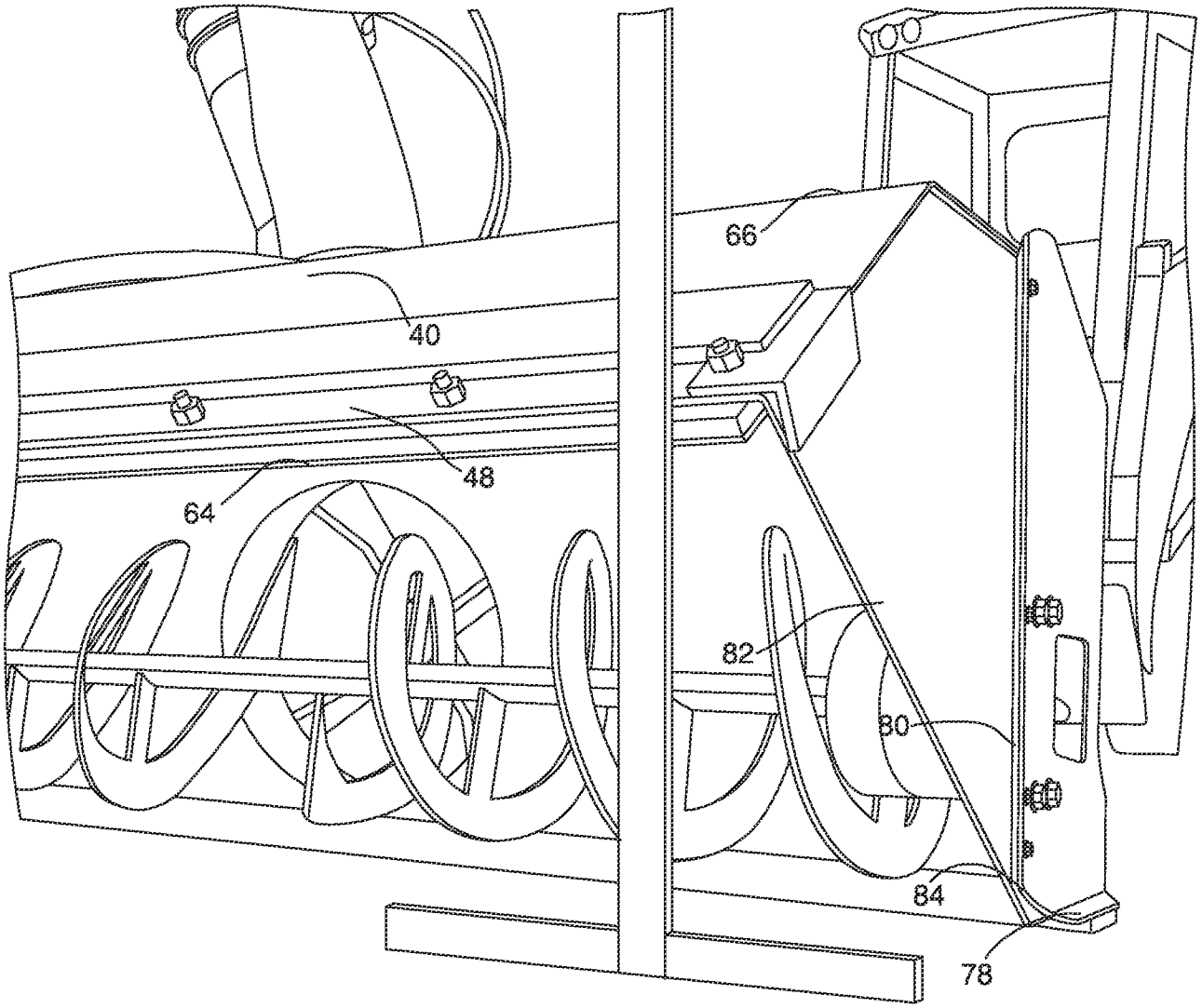
Figure 12:
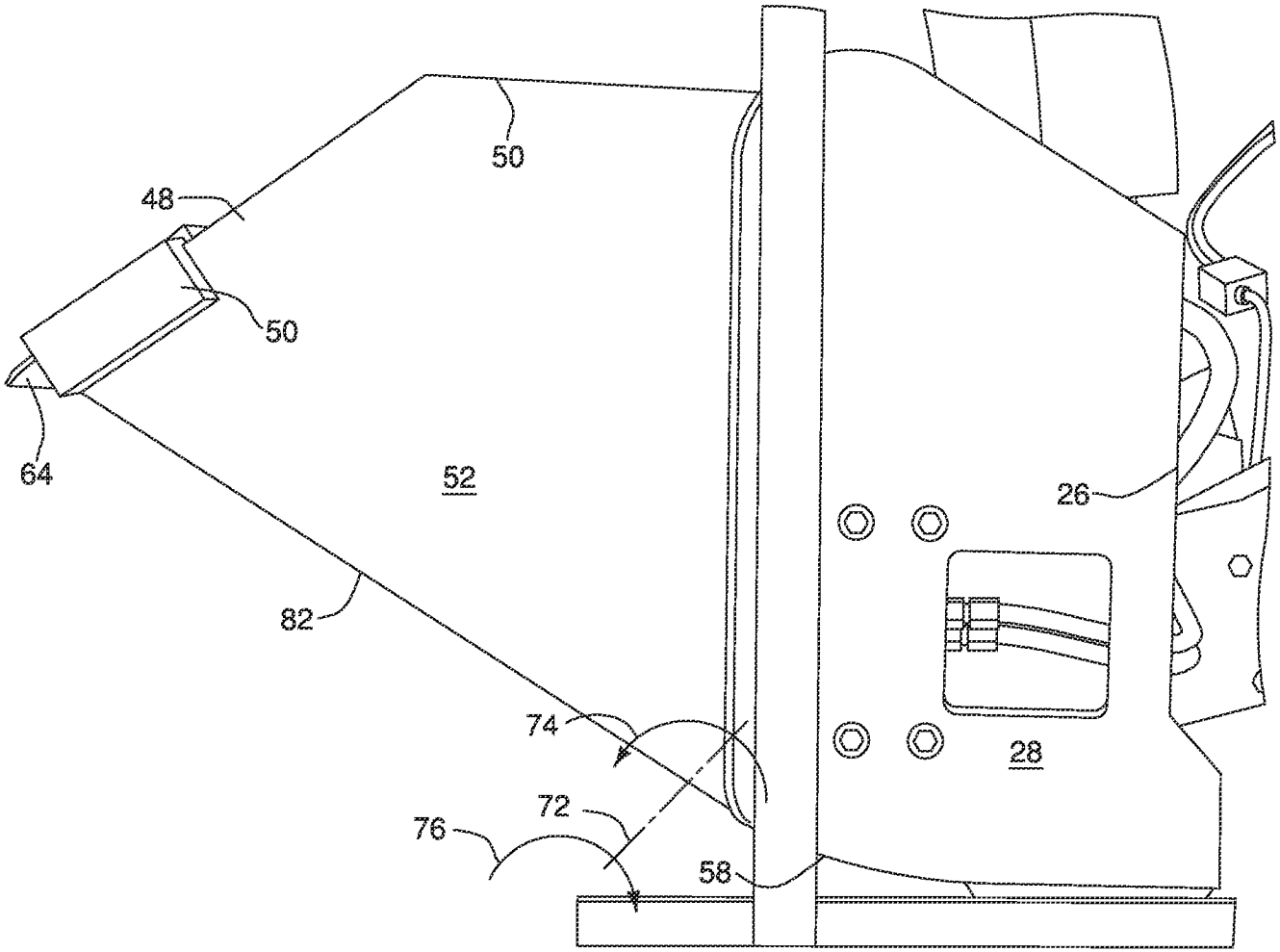
Figure 13:
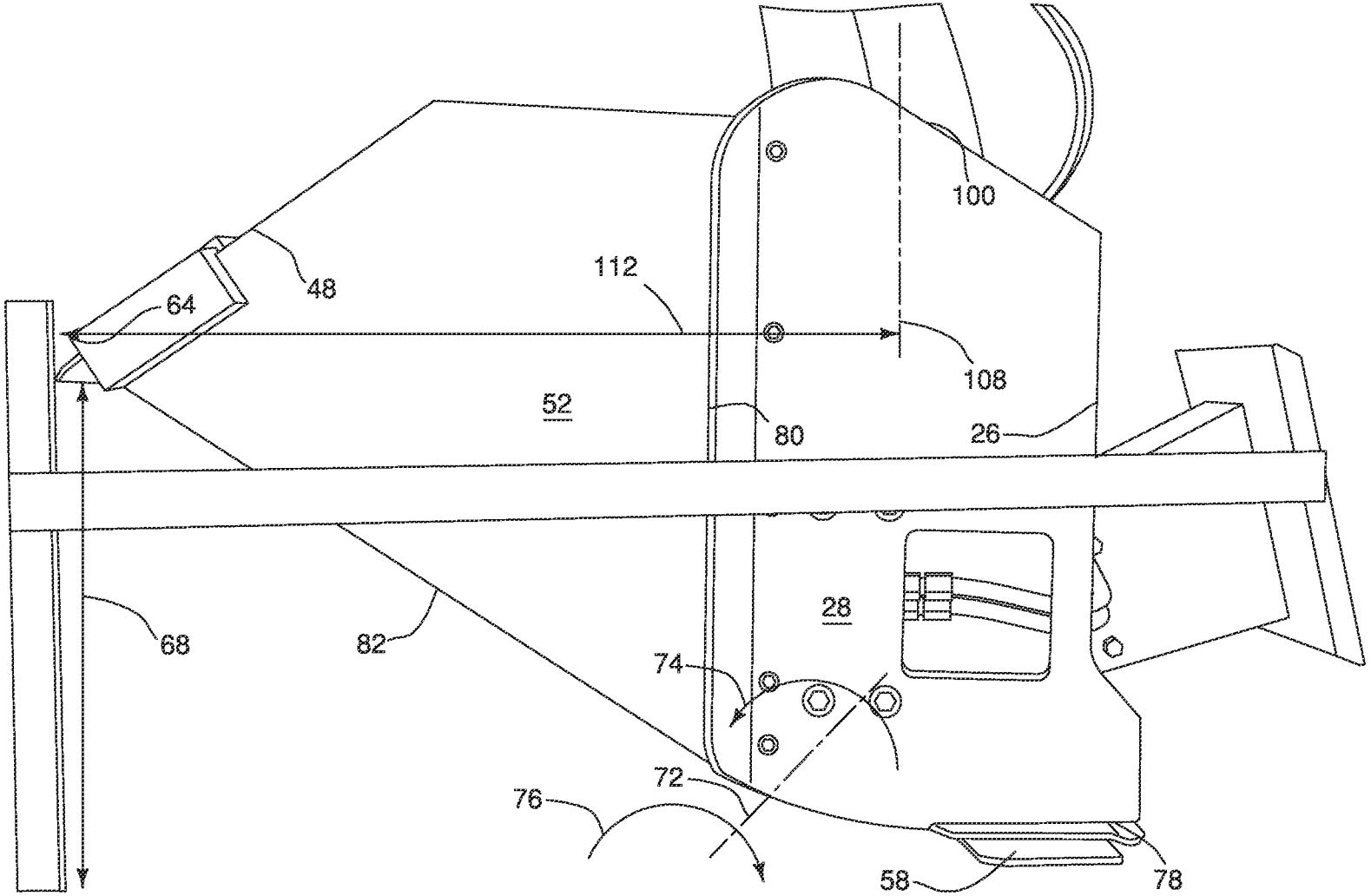
Figure 14:
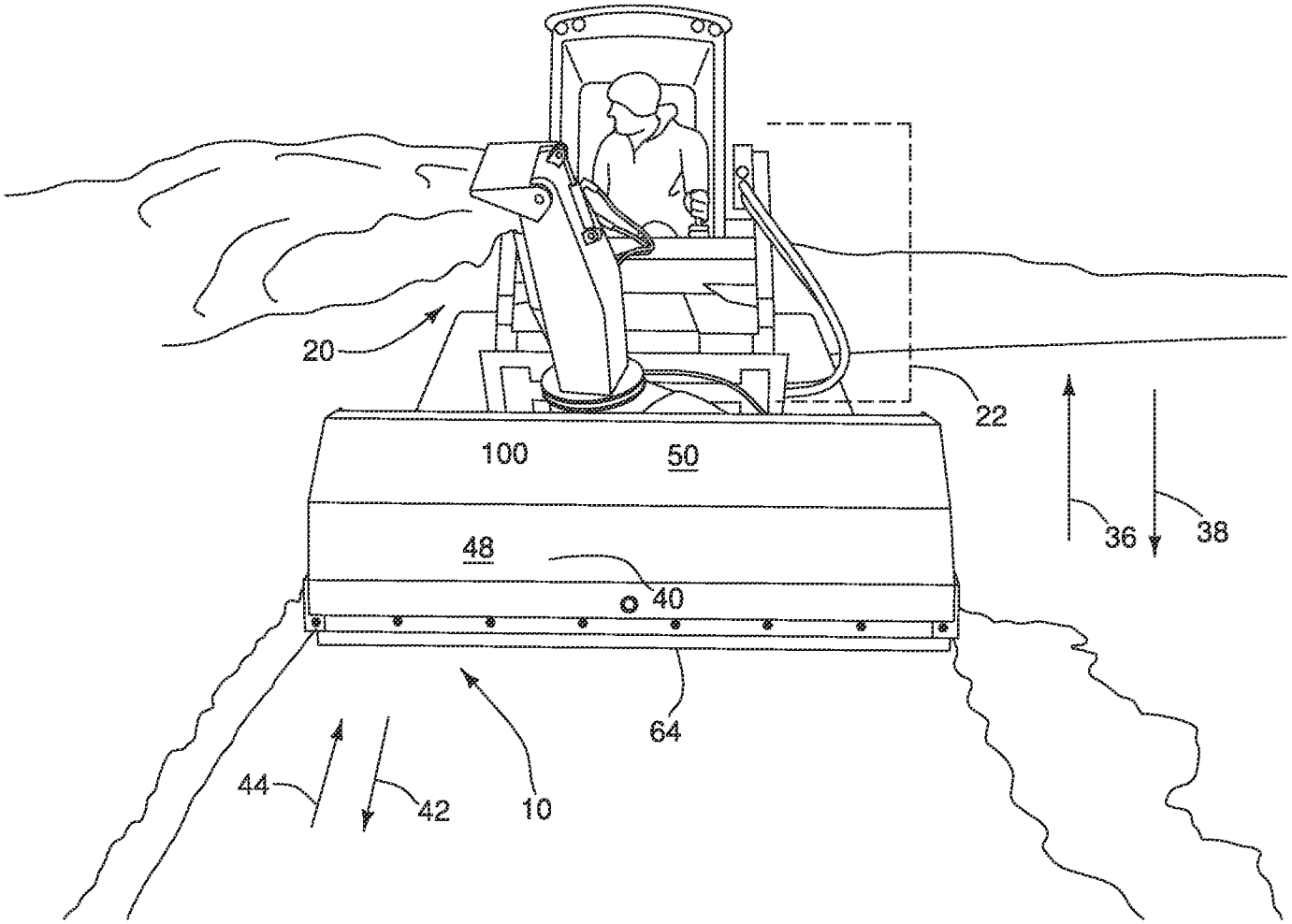
FIG. 14 is a front perspective view of a bi-directional snow blower according to any of the disclosed embodiments lowered in the second lowered position while the motorized vehicle is traveling in a reverse direction.
Figure 15:
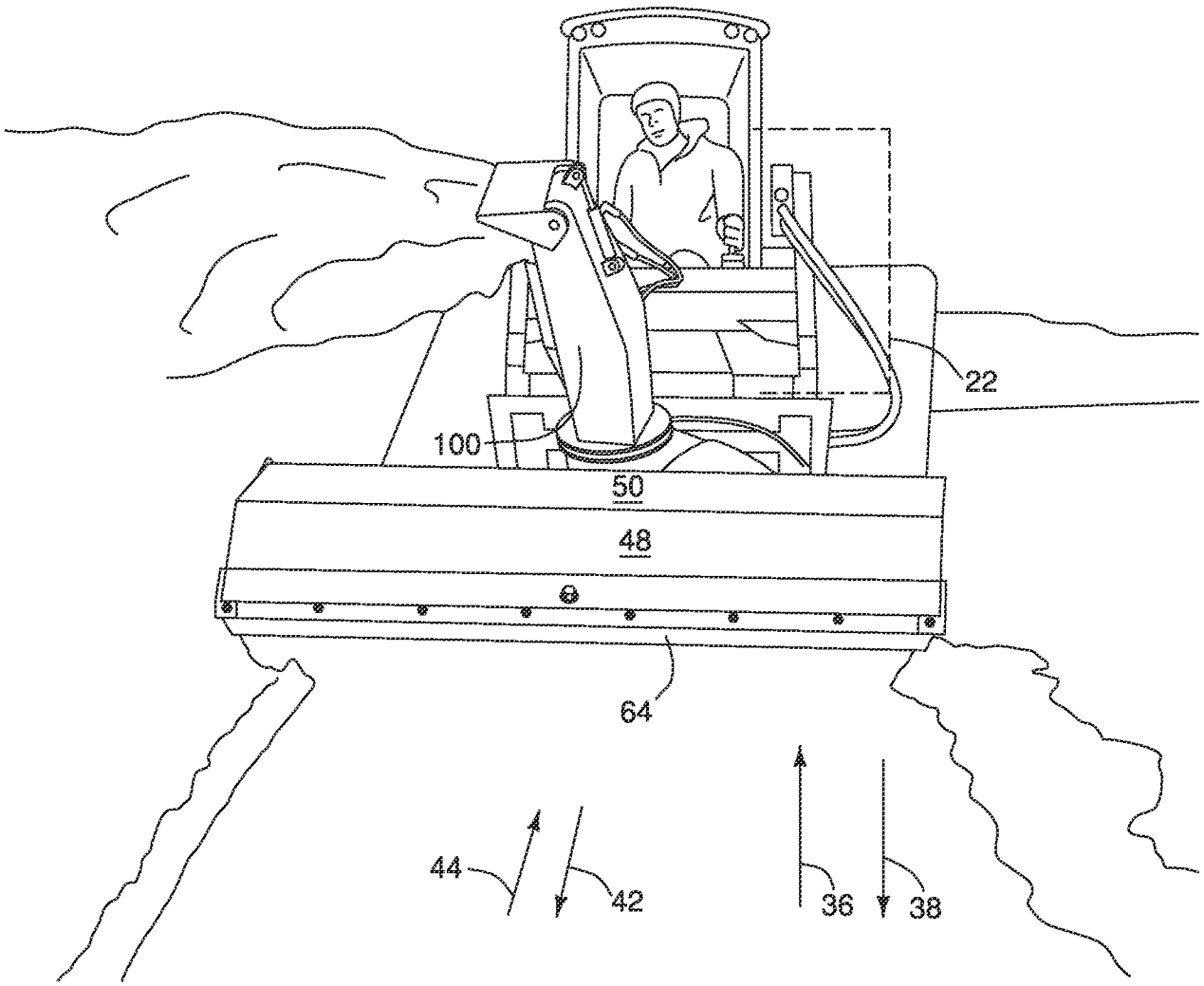
FIG. 15 is a partial front perspective view of a bi-directional snow blower according to any of the disclosed embodiments lowered in the first lowered position while the motorized vehicle is traveling in a forward direction.

The front surface 48 can have an outer edge 64, and an inner edge 66. The outer edge 64 can be opposite to the inner edge 66. The inner edge 66 can be positioned between the front surface 48 and the top surface 50. The outer edge 64 can, in some embodiments, be positioned closest to the floor surface than the inner edge 66. For instance, as seen in FIGS. 6 and 7, when the scraper blade 40 is lowered into the first lowered position or the second lowered position, the outer edge 64 can be closer to the floor surface than the inner edge 66. Further, as seen in FIGS. 6 and 7, a first distance 68 between the floor surface and the outer edge 64 in the first lowered position can be greater than a second distance 70 between the floor surface and the outer edge 64 in the second lowered position. In certain embodiments, the second distance 70 can be about zero.

The outer edge 64 may be referred to as a leading edge in embodiments where the outer edge 64 is the outermost edge of the front surface 48 (and/or the scraper blade 40), as the outer edge 64 may extend the furthest away from the top rear and bottom surfaces 56, 58 of the scraper blade 40 (and/or the back surface 26 of the frame 24).

As seen from FIGS. 6 and 7, lowering and raising the scraper blade 40 can result in lowering and/or raising one or more edges of the scraper blade 40. In the first lowered position, the bottom surface 58 can be closer to the floor surface that the outer edge 64. The bottom surface 58 can be generally parallel (e.g., in a horizontal orientation) when the scraper blade 40 is in the first lowered position. In some such embodiments, in the first lowered position, no other portion of the scraper blade 40 may extend any lower than the bottom surface 58. Alternatively or in addition, in still further embodiments, the bottom surface 58 may contact the floor surface when the scraper blade 40 is lowered to the first lowered position. Such embodiments may advantageously permit the bottom surface 58 to scrape snow from the floor and direct the scraped snow further toward an auger 90 (to be described further below).

With continued reference to FIGS. 6 and 7, to move the scraper blade 40 from the first lowered position to the second lowered position, components of the suspension mechanism (e.g., one or more linear actuators, linkages, lift arms 34) of the motorized vehicle 20 may be actuated such that the frame 24 of the snow blower is pivoted about a pivot axis 72, in the direction 74. Accordingly, because of a rigid (and/or non-rotational) connection between the frame 24 of the snow blower and the scraper blade 40, the scraper blade 40 rotates in the direction 74 as well. As a result of this movement, the outer edge 64 may be brought into proximity with the floor surface, while the bottom surface 58 may be raised away (along direction 36) from the floor surface. To move the scraper blade 40 from the second lowered position back to the first lowered position, the scraper blade 40 can be rotated in the direction 76 about the pivot axis 72.

In the second lowered position, as seen in FIG. 7, in certain cases, the outer most edge may be the closer to the floor surface than any other portion of the scraper blade 40. Further, in some such cases, the bottom surface 58 may be non-parallel to the floor surface and may form an angle therewith (e.g., between about 5 degrees and about 70 degrees) in the second lowered position.

As can be appreciated, the range of movements provided by the motorized vehicle 20 can be combined to achieve different heights to which the scraper blade 40 can be positioned and/or rotated about the pivot axis 72. For instance, as seen in FIGS. 5 and 7, the bottom surface 58 can be raised or lowered to a desired distance by the lift arms 34, once the scraper blade 40 has been pivoted to the second lowered position. Any such combination of vertical height adjustment and rotational pivoting can be provided by the motorized vehicle 20. In FIG. 5, the bottom surface 58 is at a distance of about 5 inches from the floor while in FIG. 7, the bottom surface 58 is at a distance of about 25 inches. The dimensions provided herein are illustrative, and the suspension mechanism of motorized vehicles can be customized to provide a wider range of travel of various surfaces and edges of the scraper blade 40.

When the height of the bottom surface 58 is changed, an angle formed by the front surface 48 of the scraper blade 40 with respect to the floor surface would also change. In the illustrated embodiment of FIG. 5, the front surface 48 forms an angle of between about 30 degrees and about 60 degrees with the floor surface. In the embodiment of FIG. 7, the front surface 48 forms an angle of almost about 90 degrees with the floor surface. In some such embodiments, because of the rigid and non-pivotal coupling of the frame 24 and the scraper blade 40, an increase in the angle formed by the front surface 48 with the floor surface when in the second lowered position would also be accompanied by an increase in the distance between the bottom surface 58 and the floor surface and/or an angle formed by the bottom surface 58 with respect to the floor surface.

Referring again to FIGS. 5-7, in some illustrative embodiments, each of the first and second side surfaces of the frame 24 includes a lower edge 78. The lower edge 78 of the right side of the frame 24 is illustrated, and is representative of the lower edge 78 of the left side of the frame 24. The lower edge 78 can be a bottom most edge of the each of the first and second side surfaces. The lower edge 78 can be disposed on a plane generally non-parallel (for instance, generally perpendicular) with the back surface 26 of the frame 24. The lower edge 78 can thus be generally perpendicular to a front edge 80 of the side surfaces 28, 30. Accordingly, when the front edge 80 is generally vertical, the lower edge 78 can be generally horizontal.

As perhaps best seen in FIG. 5, in exemplary embodiments, the lower edge 78 can abut the bottom surface 58 of the scraper blade 40, and/or be generally horizontal when the scraper blade 40 is in the first lowered position (as seen in FIG. 6). The lower edge 78 can also be generally non-horizontal when the scraper blade 40 is in the second lowered position as seen in FIG. 5.

With continued reference to FIGS. 5-7, according to certain aspects of the present disclosure, each of the first and second side surfaces 52, 54 of the scraper blade 40 also includes a bottom edge 82. The bottom edge 82 of the right side of the scraper blade 40 is illustrated, and is representative of the bottom edge 82 of the left side of the scraper blade 40. The bottom edge 82 can be disposed on a plane generally non-parallel (for instance, forming angle of between about 20 degrees and about 90 degrees) with the front surface 48 of the scraper blade 40. The bottom edge 82 can be generally parallel to a horizontal plane (and/or having an offset of no more than about 5 degrees relative to a horizontal plane) when the scraper blade 40 is in the second lowered position. The bottom edge 82 can also be generally non-horizontal when the scraper blade 40 is in the first lowered position, as seen in FIG. 6.

In an embodiment, the bottom edge 82 of the scraper blade 40 and the lower edge 78 of the frame 24 may be generally non-parallel with each other. Accordingly, the frame 24 can include a transitioning edge 84. The transitioning edge 84 of the right side of the frame 24 is illustrated, and is representative of the transitioning edge 84 of the left side of the frame 24. The transitioning edge 84 can abut the bottom edge 82 on a first end 86 and the lower edge 78 on a second, opposite end 88. The transitioning edge 84 can be angled to abut of the bottom edge 82 of the scraper blade 40 and the lower edge 78 of the frame 24. Accordingly, the transitioning edge 84 may be non-parallel to both the lower edge 78 and the bottom edge 82. When the scraper blade 40 is in the first lowered position and/or the second lowered position, the transitioning edge 84 may be non-horizontal. As seen in FIGS. 5-7 the angle formed by the transitioning edge 84 relative to the floor may be greater in the first lowered position than in the second lowered position.

With continued reference to FIGS. 5-7, each of the transitioning edge 84 and the bottom edge 82 may be generally non-perpendicular to a front edge 80 of each of the first and second side surfaces of the frame 24. Accordingly, when the front edge 80 of frame 24 is generally vertical, the bottom edge 82 and the transitioning edge 84 are each generally non-horizontal, and form an angle of between about 105 degrees and about 175 degrees with respect to the lower edge 78.

The angular relationship between the transitioning edge 84, the lower edge 78 and the bottom edge 82 can permit the scraper blade 40 to pivot between the first lowered position and the second lowered position without interference from edges of the frame 24. The transitioning edge 84 and the lower edge 78 of the frame 24 may not abut the floor surface when the scraper blade 40 is pivoted to the second lowered position to bring the outer edge 64 in close proximity to, or into contact with the floor surface. As the transitioning edge 84 and the lower edge 78 of the frame 24 are each angled to extend away from the floor surface, the transitioning edge 84 and the lower edge 78 may permit the outer edge 64 and/or the bottom edge 82 of the scraper blade 40 to be in close proximity to and/or contact the floor surface to scrape and remove snow more effectively. Advantageously, bringing the outer edge 64 and the bottom edge 82 in close proximity to and/or in contact with the floor surface may permit better air flow within the scraper blade 40 from a blower assembly 95 (to be described).

As perhaps best seen in FIG. 7, an auger 90 can be housed within the frame 24, and can extend between the side surfaces 28, 30 of the frame 24. According to some embodiments, referring back to FIG. 4, the auger 90 can be of a screw-type auger 90 having a spiral-shaped screw and an axle 92. The spiral screw can rotate about a rotational axis 94 that can pass through each of the side surfaces 28, 30 of the frame 24. The axle 92 can, in some cases, be centered on the rotational axis. In some embodiments, the auger 90 can be rotated by the same power source (e.g., motor) as the motorized vehicle 20. Alternatively, the auger 90 can be rotated by a separate power source, such as a motor housed within the frame 24 of the snow blower and is operatively coupled to the axle 92 of the auger 90.

The snow blower includes a blower assembly 95 housed within the frame 24. The blower assembly 95 can be centrally housed as shown in FIG. 4 in the blower housing 96. The auger 90 can, advantageously, direct snow removed by a scraping blade toward the blower assembly 95. The blower assembly 95 can be powered by the same power source as the vehicle 20. Alternatively, the blower assembly 95 can include an auxiliary power source, such as a separate motor. In an example, the blower assembly 95 can include a centrifugal type blower. In such cases, the blower can gather snow collected by the auger 90 (e.g., the screw member during their rotation), and direct the collected snow radially inwardly toward an outlet of the blower assembly 95. Other types of fans, blowers, and the like are also contemplated.

Referring back to FIGS. 1-3, the snow blower includes a chute 100. The chute 100 can have an inlet 102 (best seen in FIG. 3) and an outlet 104. The inlet 102 of the chute 100 can be in fluid communication with the outlet of the blower assembly 95 such that snow directed by the auger 90 and collected by the blower assembly 95 may leave the blower assembly 95 via the blower assembly 95's outlet, and enter the chute 100. The chute 100 may have an outlet 104 to direct snow away from the snow blower.

The chute 100 can extend outwardly from the upper surface 106 of the frame 24. In certain embodiments of the present disclosure, the chute 100 can be rotatable relative to the scraping blade and/or the frame 24 of the snow blower. For instance, in an example, the chute 100 can rotate about a rotational axis 108 as shown by the arrows in FIG. 3. As seen from FIG. 3, the rotational axis can be generally perpendicular to the upper surface 106 of the frame 24. In certain embodiments, the rotation of the chute 100 can permit directing snow away from areas other than intended areas, as will be described further below.

In certain aspects, the chute 100 can be rotated by way of a powered drive. In one example, the powered drive can be powered by the same power source as the motorized vehicle 20 (e.g., a battery-operated motor). Accordingly, electrical coupling between the power source of the motorized vehicle 20 and the chute 100 can be accomplished, for instance by way of electrical cables. Alternatively, the chute 100 can have its own power source, such as a motor.

Figure 16:
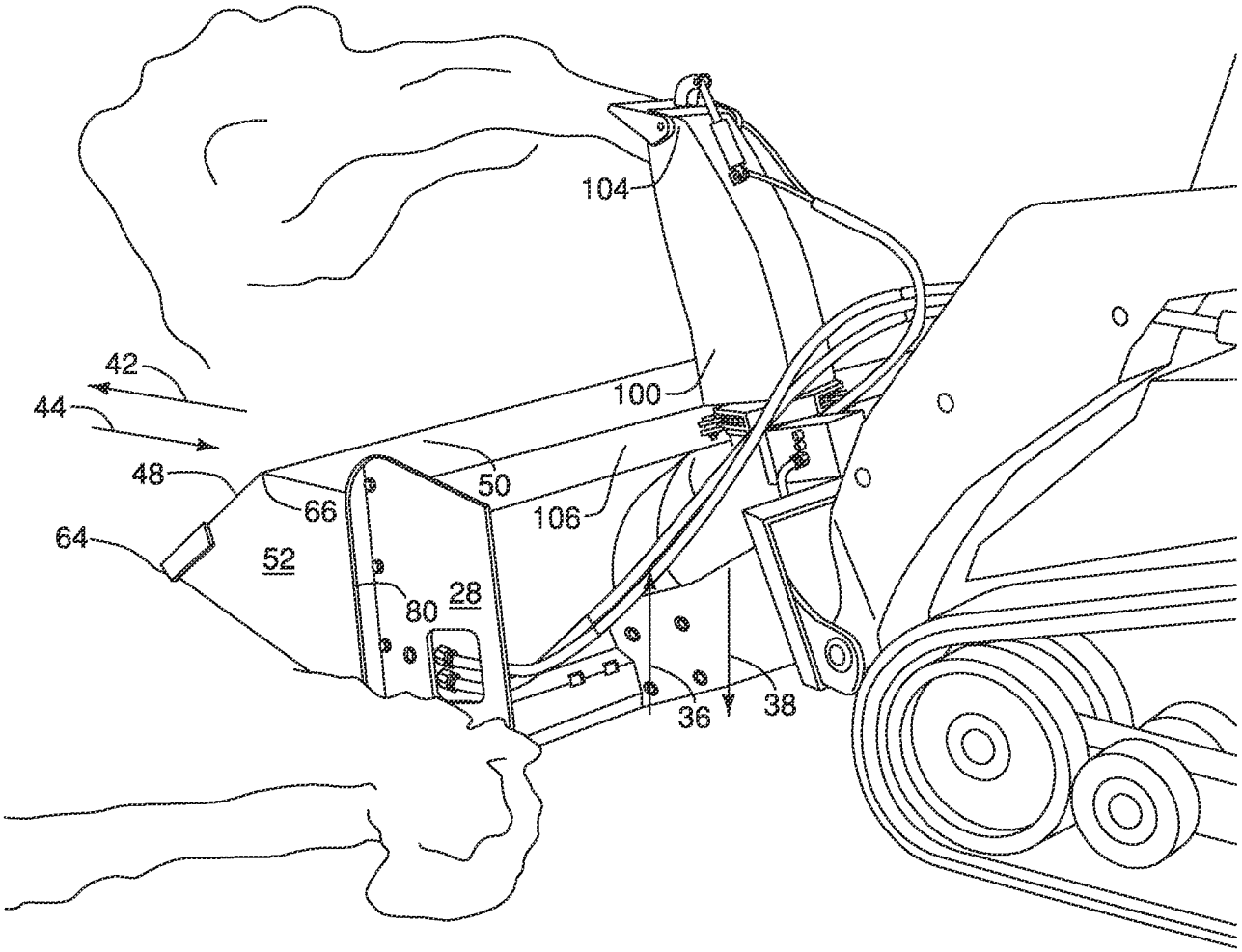
FIG. 16 is a partial side perspective view of a bi-directional snow blower according to any of the disclosed embodiments lowered in the first lowered position while the motorized vehicle is traveling in a forward direction.
Figure 17:
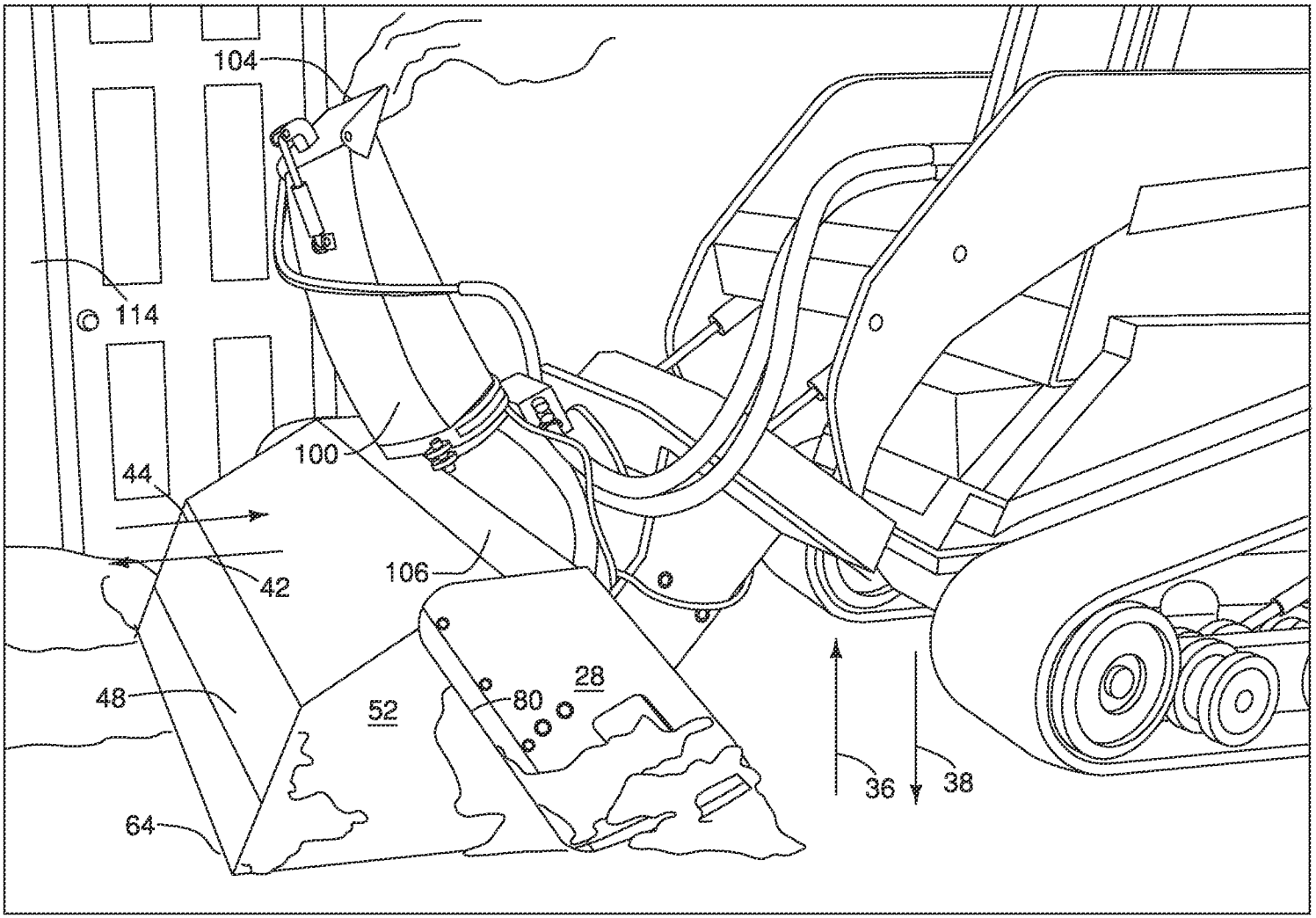
FIG. 17 is a partial front perspective view of a bi-directional snow blower according to any of the disclosed embodiments lowered in the second lowered position while the motorized vehicle is traveling in a reverse direction while removing snow in the proximity of an exterior vertical wall.

According to some embodiments, an outlet 104 of the chute 100 can be contoured to facilitate directing snow in a preferred direction 74. In an example, the outlet 104 of the chute 100 has a nozzle such that the direction 74 of dispersion of snow can be controlled precisely. Such embodiments may facilitate removing snow from surfaces that are in close proximity to exterior vertical surfaces such as walls, doors, siding and the like. For example, while during normal operation, the outlet 104 of the chute 100 may be generally oriented to face away from the front of the motorized vehicle 20 (as shown in FIG. 16, for instance) when the vehicle 20 is moving in the forward direction 42, the chute 100 may be rotated such that the outlet faces toward the front of the motorized vehicle 20, and yet direct snow laterally (as shown in FIG. 17).

FIGS. 1-3 illustrate various relative positions of the scraper blade 40 and the chute 100 during the first and second lowered positions. According to certain advantageous embodiments, the chute 100 can be positioned to the rear of the scraper blade 40 such that when the scraper blade 40 is lowered (e.g., into the first lowered position or the second lowered position), portions of the chute 100 may be protected and/or prevented from abutting any vertical surfaces that may be in the path of snow removal.

In one embodiment, the chute 100 can be positioned exterior to the scraper blade 40, and to the rear of the back surface 26 of the frame 24 of the snow blower. In some such embodiments, a height 110 of the chute 100 is less than a distance 112 between the outer edge 64 of the scraper blade 40 and the rotational axis of the chute 100. In the illustrated embodiment, the outer edge 64 can be a leading edge that is closest to, or the first edge of the scraper blade 40 to contact the floor surface from which snow is to be removed when the scraping blade is in the second lowered position. The leading edge can be the outermost edge of the scraping blade and can be the farthest edge relative to the back surface 26 of the frame 24. Accordingly, when positioned as such, the chute 100 may not intercept surfaces (e.g., walls, siding, or other objects) adjacent to the leading edge of the scraper blade 40, when the scraper blade 40 is lowered toward the floor surface for snow removal.

FIGS. 10-13 illustrate (to scale, in inches and/or degrees) various views of the snow blower according to exemplary embodiments. The dimensions (in inches) of various components and angular relationships (in degrees) thereof are illustrated herein according to one embodiment. It should be understood that the disclosed dimensions and angular relationships should not be construed as limiting.

FIGS. 14-20 illustrate various views of the snow blower according to any of the disclosed embodiment during use. The operations described below may be performed by an operator or autonomously. In use, in an embodiment, the motorized vehicle 20 can be positioned at a location from where snow is to be cleared. The scraper blade 40 may be positioned in a raised position (as shown in FIG. 4) to transport the scraper blade 40 to the destination, from where snow is to be removed.

After reaching the destination, the scraper blade 40 can be lowered to the first lowered position (FIGS. 15, 16 and 18), and continue driving the vehicle 20 forward. At this point, the bottom surface 58 of the scraper blade 40 may be in close proximity to or in contact with the floor surface from which snow is to be cleared. At this position, the outer edge 64 is raised to a height above the bottom surface 58, and the bottom edge 82 and the transitioning edge 84 may generally be non-vertical. Further, the lower edge 78 may be oriented generally horizontally. As the vehicle 20 continues to move forward, snow may be scraped by the bottom surface 58 and directed toward the auger 90, and blown away from the scraper blade 40 via the chute 100.

In some embodiments, once the vehicle 20 is moved to a forward most point of travel, the scraper blade 40 can be pivoted (e.g., by engaging the suspension mechanism) to lower the outer edge 64 toward the floor surface and raise the bottom surface 58 away from the floor surface. The outer edge 64 may, at this instance, be the portion of the scraper blade 40 that is lowest and positioned closest to the floor surface. The vehicle 20 can be reversed (e.g., by engaging the vehicle 20's transmission system and/or controls) as shown in FIGS. 14, 17, 19 and 20 to move in a direction 44 opposite to the forward direction 42. Advantageously, the outer edge 64 may pull snow into the enclosure 60 of the scraper blade 40 that houses the auger 90 when the vehicle 20 is traveling in a reverse direction 44.

Figure 18:
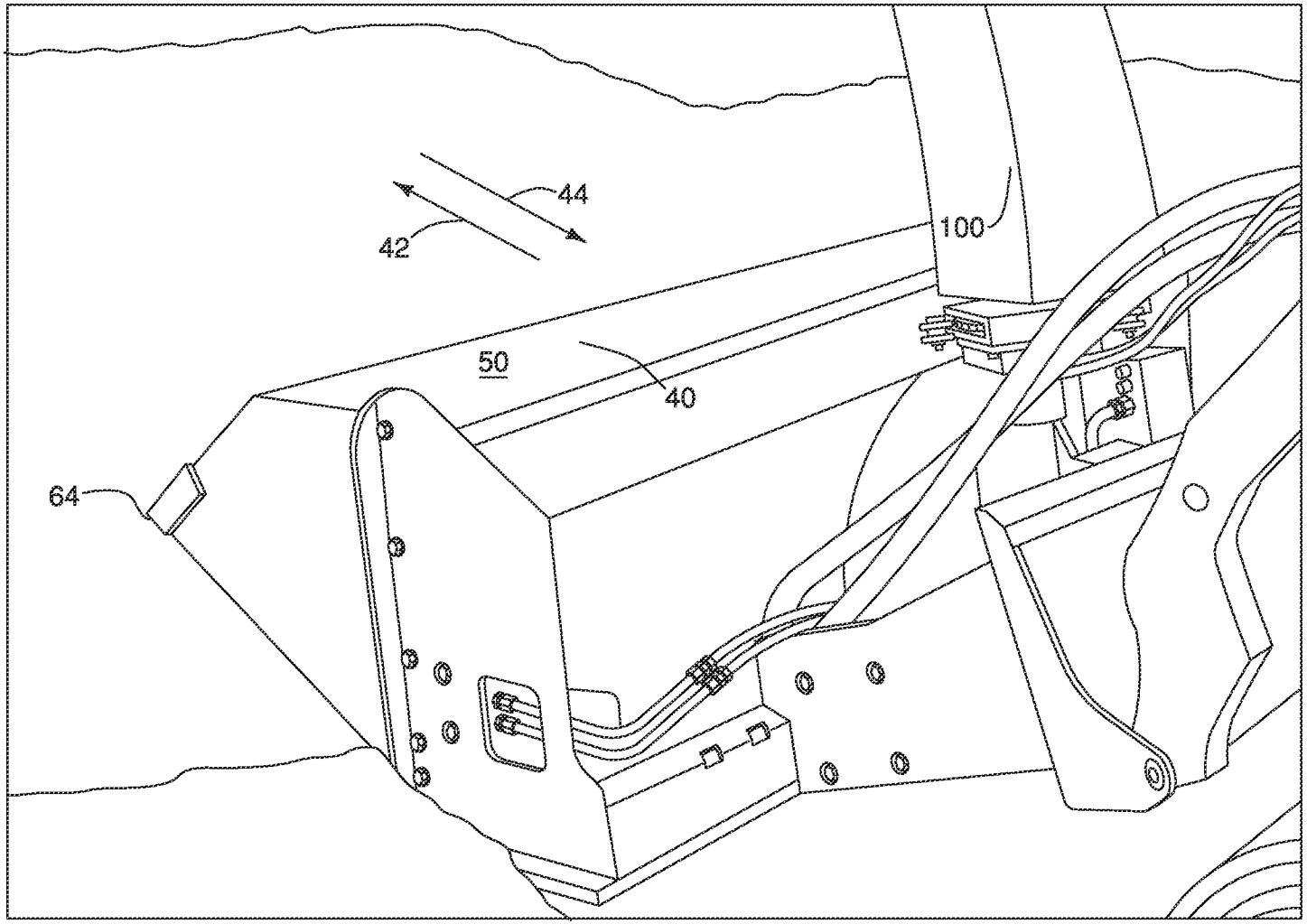
FIG. 18 is another partial perspective view of a bi-directional snow blower according to any of the disclosed embodiments lowered in the first lowered position while the motorized vehicle is traveling in a forward direction.
Figure 19:
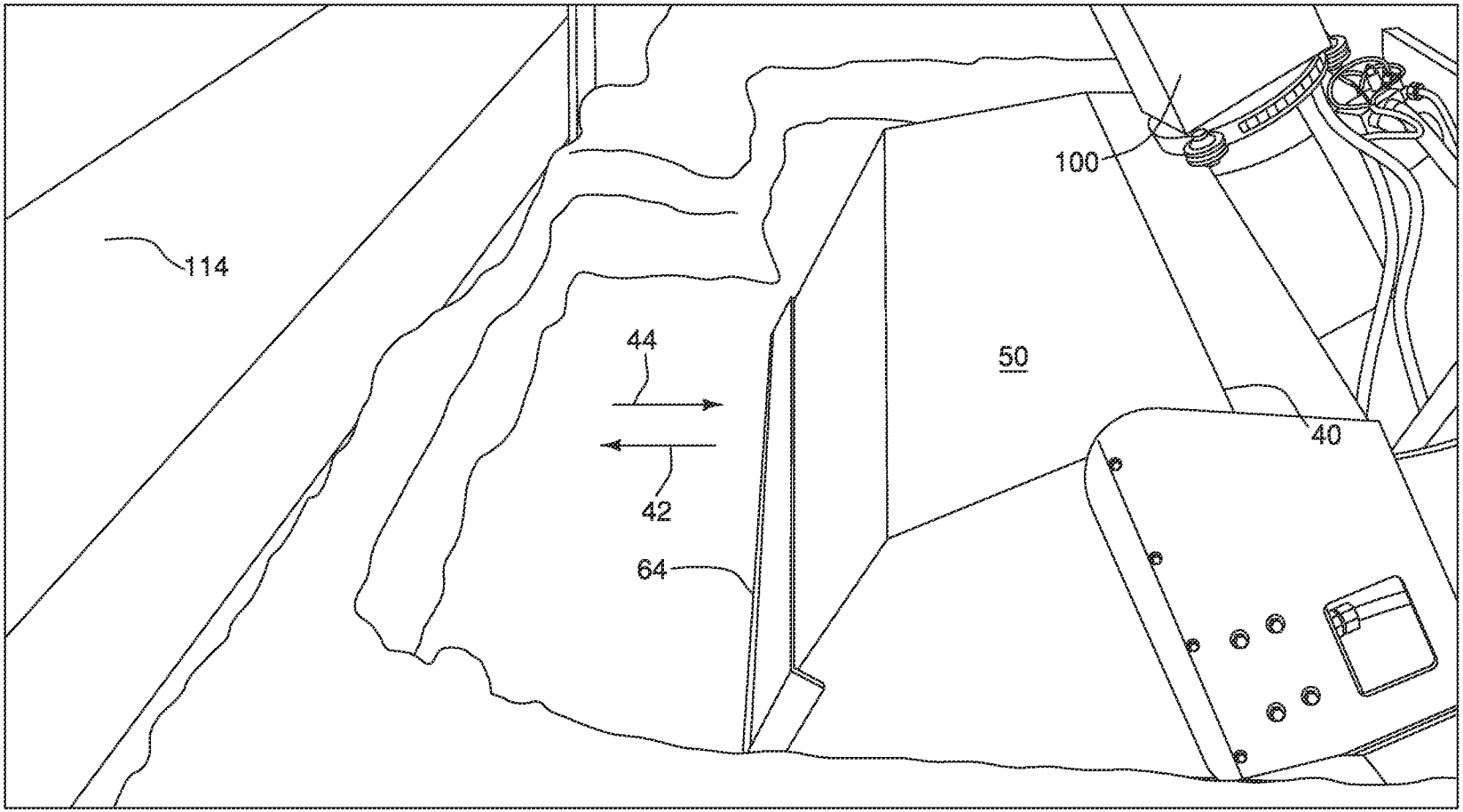
FIG. 19 is another partial front perspective view of a bi-directional snow blower according to any of the disclosed embodiments lowered in the second lowered position while the motorized vehicle is traveling in a reverse direction while removing snow in the proximity of another exterior vertical wall.
Figure 20:
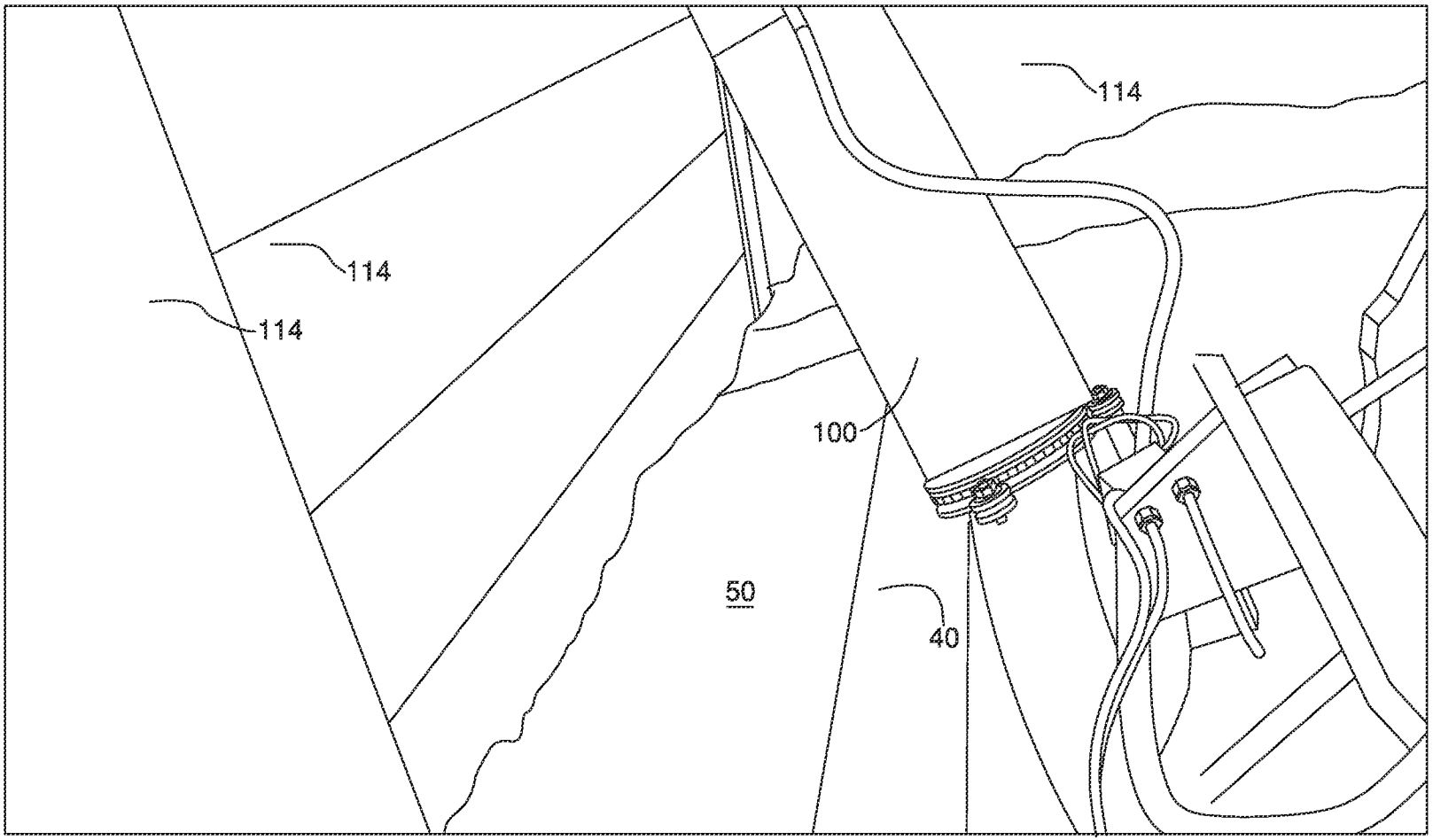
FIG. 20 is a partial front perspective view of a bi-directional snow blower according to any of the disclosed embodiments lowered in the second lowered position with the chute rotated away from an exterior wall, while the motorized vehicle is traveling in a reverse direction while removing snow in the proximity of the exterior vertical wall.

In advantageous embodiments, the vehicle 20 can be positioned as close as possible to an exterior vertical surface 114 (e.g., a siding, door, or an exterior wall) as shown in FIGS. 18, 19 and 20 when traveling in the forward direction 42. For example, the vehicle 20 may be moved in the forward direction 42 until the outer edge 64 is as close as possible to the vertical surface 114 without physically contacting the vertical surface 114. At this position, the scraper blade 40 can be pivoted to the second lowered position, and the vehicle 20 moved in reverse direction 44 to remove snow that has accumulated in close proximity to the exterior vertical surface.

Figure 21:
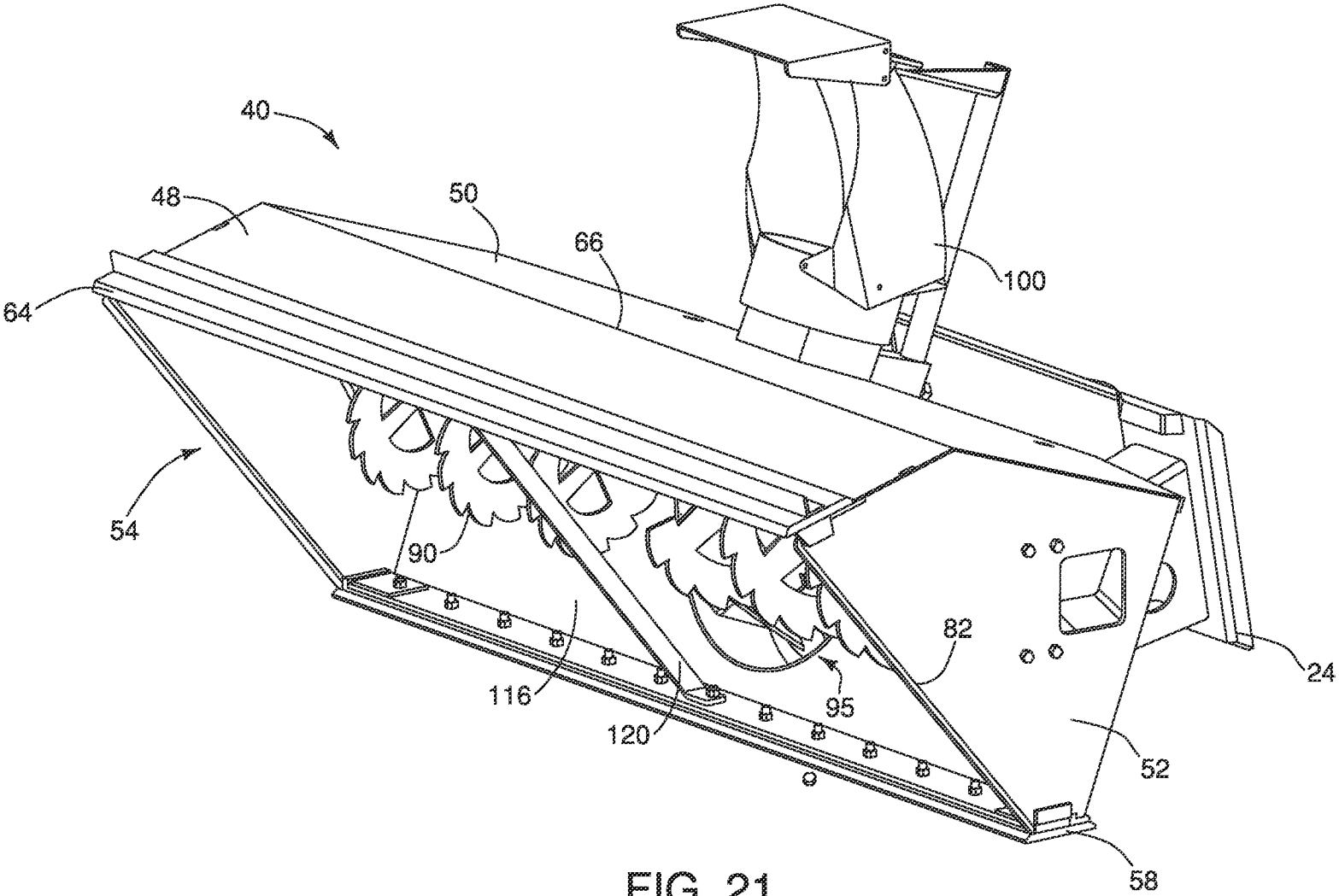
FIGS. 21 and 22 illustrate additional views of a blower assembly of a bi-directional snow blower according to any of the disclosed embodiments.
Figure 22:
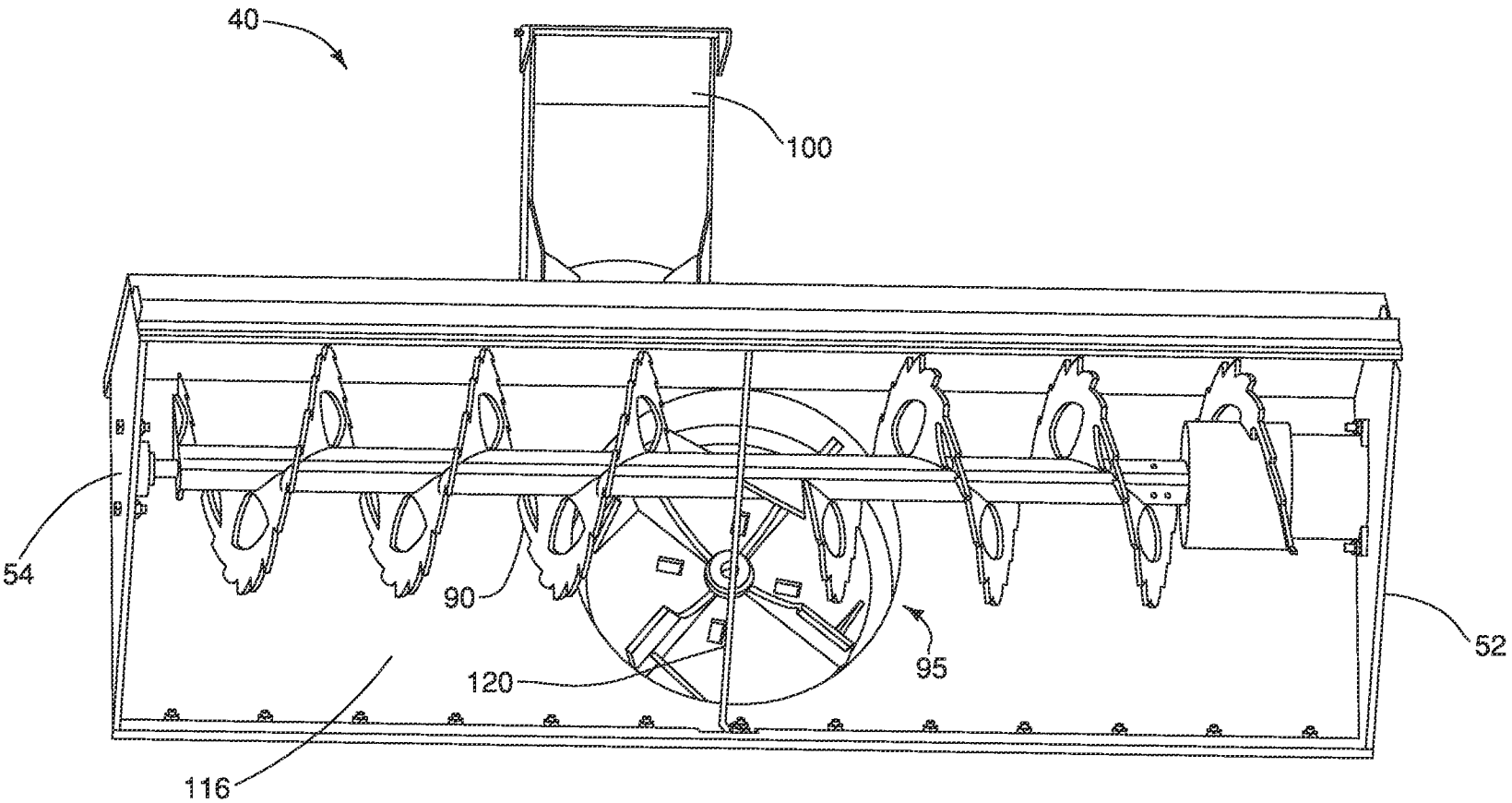

FIGS. 21 and 22 illustrate additional views of a bi-directional blower assembly 95 according to another embodiment. The embodiment of FIGS. 21 and 22 is substantially similar to the embodiments of FIGS. 1-20, as evidenced by like reference numerals being used to connote like elements. However, unlike the embodiments of FIGS. 1-20, the bi-directional blower assembly 95 of FIGS. 21 and 22 the lower edge 78 and the bottom edge 82 may be angled such that they may directly abut one another without a transitioning edge.

As was the case with the embodiments of FIGS. 1-20, the embodiments of FIGS. 21 and 22 may also include a box blade with a front surface 48, a top surface 50 abutting the front surface 48, and a pair of side surfaces 52, 54. However, unlike the embodiments of FIGS. 1-20, the embodiment of FIGS. 21-22 includes a rear surface 116. The front surface 48, the top surface 50, the rear surface 116 and the pair of side surfaces 52, 54 may define an enclosure 60 of the box blade. Optionally, a support brace 120 may be positioned in the enclosure 60 to improve support and mechanical strength of the box blade.

Figure 23:
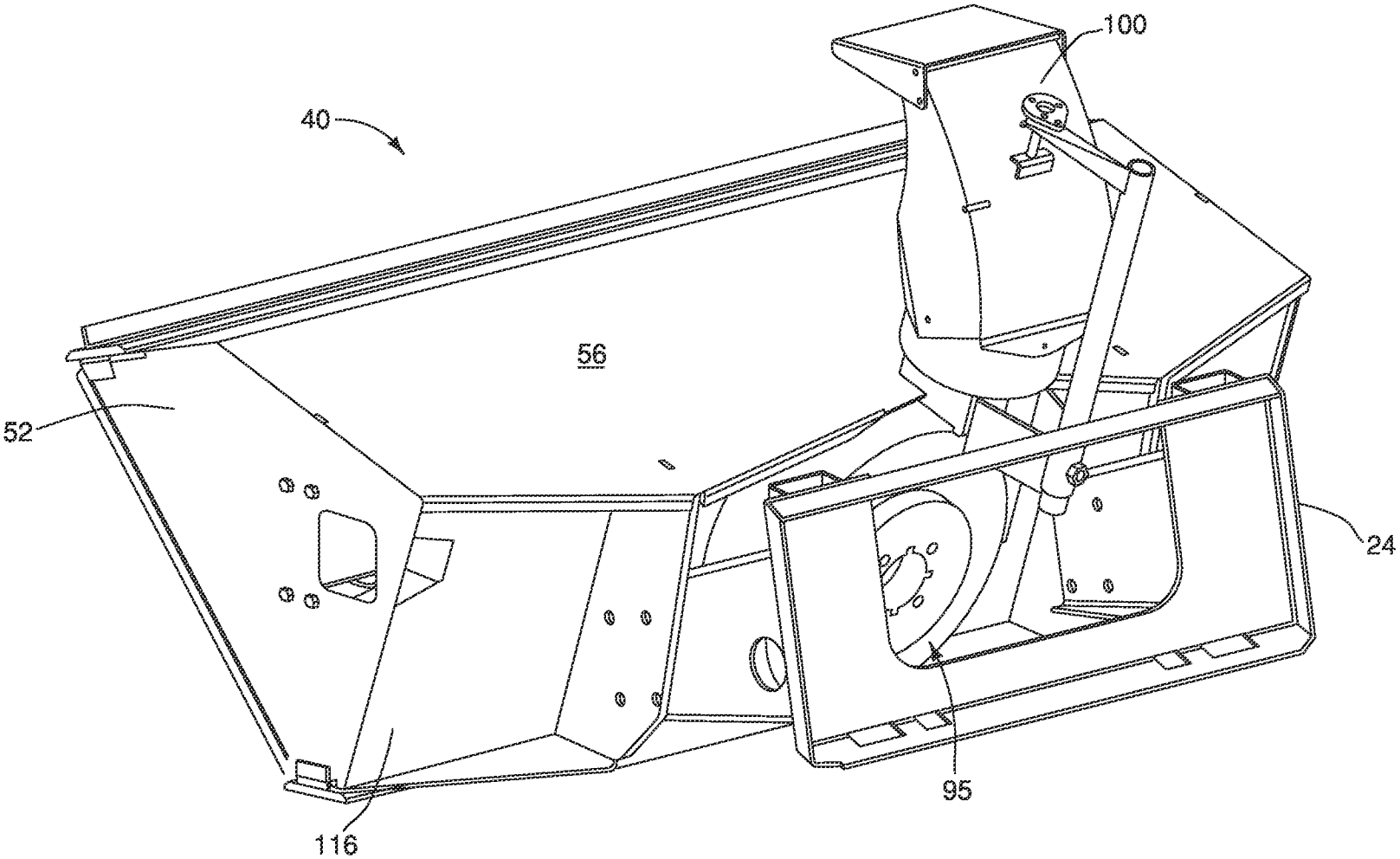

As seen in FIGS. 22 and 23, as was the case with FIGS. 1-20, the blower assembly 95 (e.g., blower frame 96) is housed within the enclosure 60 of the box blade (e.g., in a recess on the rear surface 116) and thereby integrated into the scraper blade. Such construction may advantageously permit the blower assembly 95 to maintain a vacuum within the enclosure 60 of the box blade when the scraper blade is lowered into the second lowered position, and thereby fluidly isolate the enclosure 60 of the box blade from the exterior. The vacuum may draw particulate such as snow (e.g., from near the side surfaces 52, 54) into the box blade and direct the drawn particulate toward the chute 100.

Additionally, in advantageous aspects, an integrated blower assembly 95 housed within the scraper blade may be used to exert down pressure. For instance, when the scraper blade is lowered into the second lowered position (e.g., FIGS. 1, 5, 14, and 20) a weight of the blower assembly 95 may exert down pressure on the scraper blade. The down pressure may be advantageous in instances when the scraper blade removes compacted particulate (e.g., snow pack or ice) from the floor surface.

Referring back to FIGS. 21-23, the rear surface 116 of the box blade may non-perpendicular with respect to the floor surface when the scraper blade is lowered into the first lowered position or the second lowered position. In the illustrated embodiment of FIGS. 21-23, the rear surface 116 forms an angle greater than 90 degrees (e.g., about 120 degrees) with respect to the floor surface. Other angles are contemplated, for instance between about 95 degrees and about 175 degrees. Such embodiments may facilitate a contoured passageway for the particulate drawn in by the blower assembly 95, and direct the drawn particulate into the chute 100 in a streamlined manner.

As described previously, in advantageous embodiments, the chute 100 can be rotated about its central axis to a position where the chute 100 (or portions thereof) does not abut the exterior vertical surface 114 when the scraper blade 40 is pivoted between various positions. Such embodiments protect components of the snow blower while permitting bi-directional snow removal, thereby effectively reducing the amount of time for clearing snow from an area.

Figure 25:
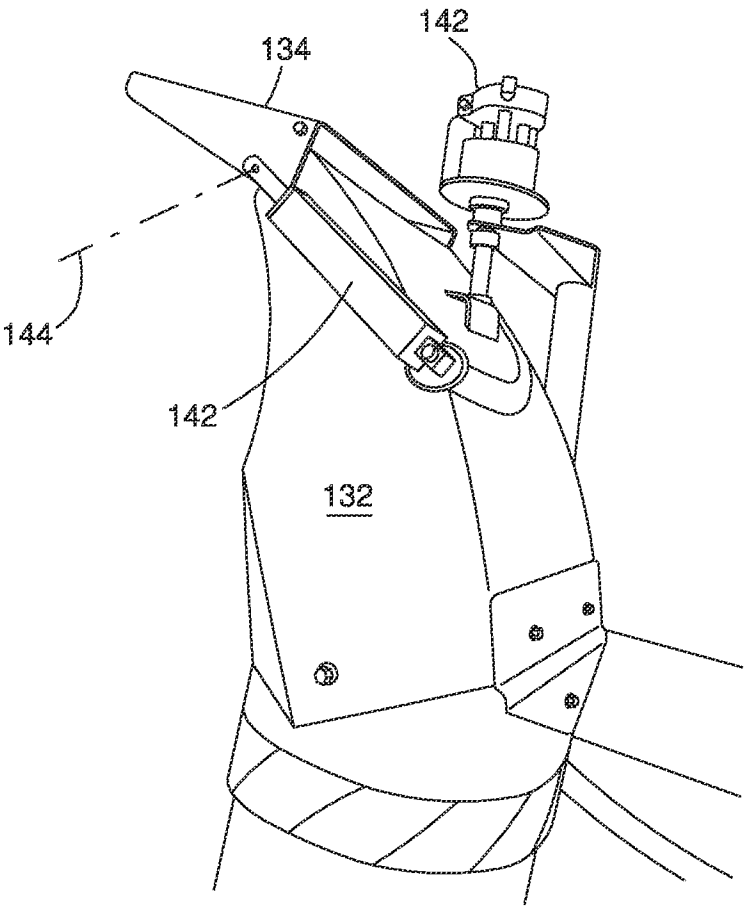
FIGS. 24 and 25 illustrate various details of a chute of a bi-directional snow blower according to any of the disclosed embodiments.
Figure 24:
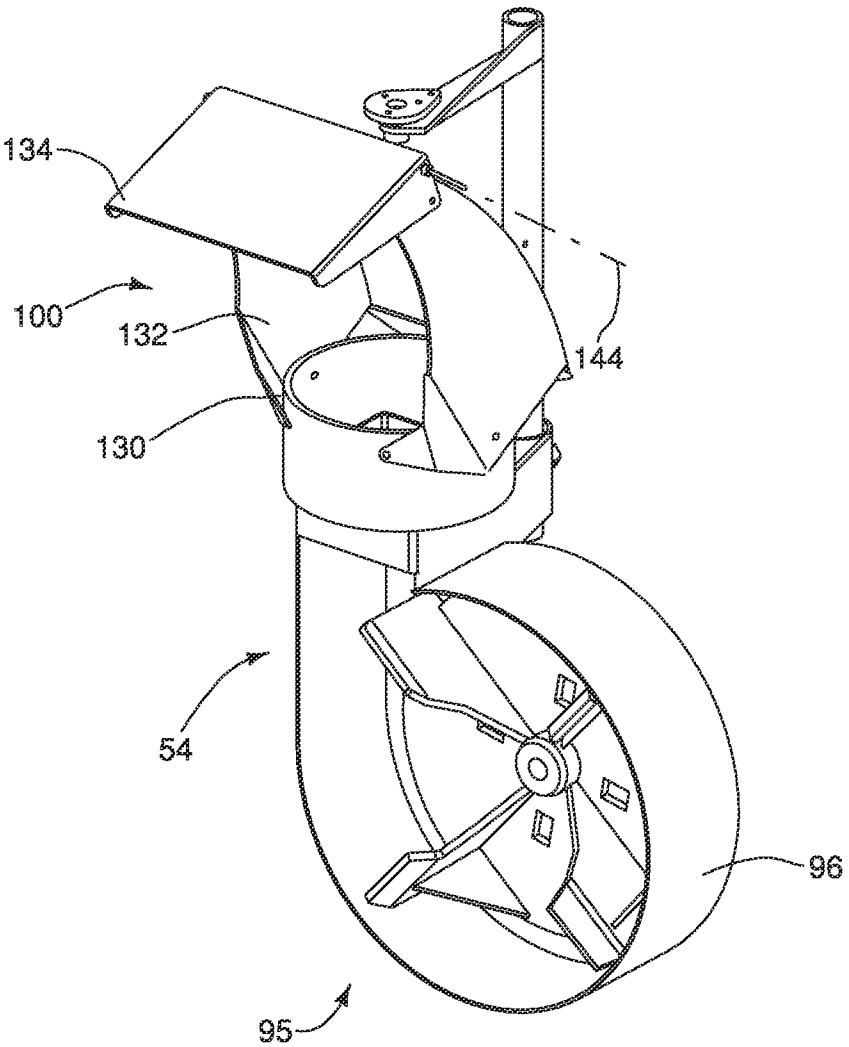

FIGS. 24 and 25 illustrate various detailed views of the chute 100. As seen therein, the chute 100 includes an inlet 130 fluidly coupled to a hollow internal passage 132, and an outlet 134 fluidly coupled to the hollow internal passage 132. In advantageous embodiments, the inlet of the chute 100 may be directly coupled to an outlet of the blower assembly 95 so as to establish fluid communication therebetween. Such embodiments may result in a simplified construction because of the direct coupling between the blower and the chute 100.

As described above, the chute 100 is rotatable such that the outlet 134 of the chute 100 is oriented away from the motorized vehicle 20 to facilitate effective removal of snow or other particulate. As seen in FIG. 25, a powered drive (e.g., an electric motor 140) may be coupled to the chute 100 to provide torque and thereby rotate the chute 100 coupled thereto. In an illustrative embodiment, the electric motor 140 may be directly coupled to (e.g., mounted on a support mount positioned on) the chute 100. Such embodiments may advantageously lead to simplified construction and may use fewer electric cables and/or torque transmission components than in conventional chute 100 systems.

In exemplary embodiments, the chute 100 may be rotated such that the outlet 134 forms an angle between about zero degrees and about 175 degrees relative to the forward direction 42 of travel of the motorized vehicle 20. Angles greater than 90 degrees (as seen in FIG. 17) may be particularly useful when removing particulate such as snow in tight spaces (e.g., narrow driveways). Further, the chute 100 may be of a height sufficient to not abut into nearby vertical spaces, and permitting a clear line of sight for an operator operating (e.g., in a seated or standing position) in the motorized vehicle 20.

In certain embodiments, the outlet 134 of the chute 100 may pivot relative to the hollow internal passage 132 of the chute 100. For instance, as illustrated in FIG. 25, the outlet 134 of the chute 100 may be pivotally coupled to the hollow internal passage 132 of the chute 100 by a linear actuator 142. Actuation or retraction of the linear actuator 142 may pivot the chute 100 about the pivot axis 144 and orient the outlet 134 relative to the hollow internal passage 132, and thereby direct particulate away from the bi-directional snow blower 10. Such embodiments may also facilitate effective removal of particulate such as snow from tight spaces (e.g., narrow driveways) because of the ability to orient the outlet of the chute 100 in preferred directions.

Figure 26:
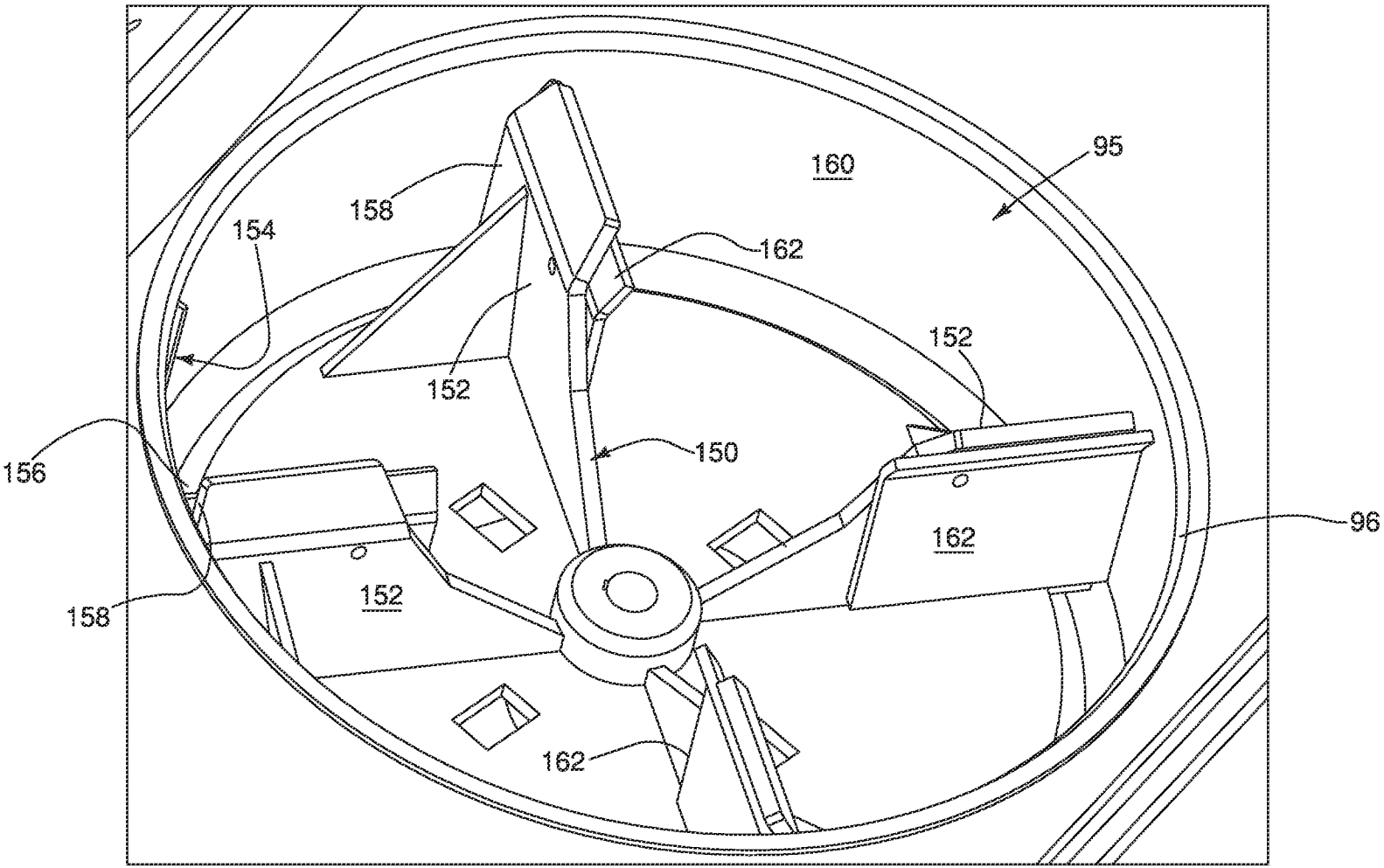
FIG. 26 illustrates a blower assembly with enhanced efficiency of a bi-directional snow blower according to any of the disclosed embodiments.

FIG. 26 shows an embodiment of the blower assembly 95 with enhanced efficiency. Like other embodiments, the blower assembly 95 of FIG. 26 includes a blower frame 96, an impeller 150 with one or more impeller blades 152, and an outlet 154 of the blower assembly leading to the chute. For purposes of manufacturing tolerances and processes, it is common to leave a ¼" or ½" gap 156 or a clearance between the radially outer edge 158 (along its entire axial width) of the impeller blades 152 and the interior surface 160 of the blower frame 96. In the embodiment shown in FIG. 26, a shim pad 162 is connected onto the front or leading face of each impeller blade 152. The connection may made be in any suitable manner, including rivets, bolts, glue, etc. that retains the shim pad 162 during normal use of the impeller 150. The shim pad 162 is positioned radially relative to the impeller blade 152 in such manner that the shim pad 162 reduces or eliminates the gap 156. In some embodiments, the shim pad 162 extends radially towards the interior surface 160 of the blower frame 96 such that the shim pad 162 contacts the interior surface 160 of the blower frame 96. In some embodiments, the shim pad 162 extends radially past the gap 156 such that the interior surface 160 of the blower frame causes the shim pad to deflect or fold along (e.g., circumferentially) the interior surface 160. By reducing or eliminating the gap 156 between the interior surface 160 and the combined shim pad 162 and impeller blade 152, the resulting blower assembly 95 operates with enhanced efficiency. For its size, the blower vacuum and pressure are increased relative to a blower assembly with the gap 156. The result is a blower assembly that blows snow further with less power. In some embodiments, each shim pad 162 may be formed of a material that is resilient and/or wear resistant material, such as Ultra High Molecular Low Weight Polyurethane (UHMW). When using such a material, it is believed that contact between the shim pad 162 and the interior surface 160 will cause the shim pad 162 to rapidly (e.g., within a few minutes of initial use of the blower assembly 95) wear down until there is minimal clearance between the shim pad 162 and the interior surface 160. When operating with such minimal clearance and without contact, frictional contact between the shim pad 162 and the interior surface 160 will no longer reduce the efficiency of the blower assembly 95.

Embodiments such as those disclosed herein provide numerous advantages. According to embodiments, the bi-directional snow blower 10 can remove snow during forward and reverse directions of travel of the motorized vehicle 20. The disclosed embodiments also involve the use of fewer parts and are of a simplified construction than conventional snow blower.

The invention claimed is:

1. A bi-directional snow blower coupled to a motorized vehicle, the bi-directional snow blower comprising:

a frame coupled to a suspension mechanism of the vehicle;

a scraper blade for removing particulate from a floor surface on which the scraper blade is engaged therewith, the scraper blade being rigidly and non-pivotally coupled to the frame, the rigid and non-pivotal coupling between the scraper blade and the frame facilitating movement of the scraper blade together with the frame when the frame is moved non-rotationally and/or rotationally by the suspension mechanism of the vehicle, the rotational and/or non-rotational movement of the scraper blade facilitating removal of particulate from the floor surface when the vehicle is traveling in a forward direction and in a reverse direction opposite to the forward direction, the forward direction and the reverse direction corresponding to directions of travel relative to a transverse center plane of the vehicle, the scraper blade is movable between a first lowered position, a second lowered position and a raised position, wherein the first lowered position corresponds to removal of particulate when the motorized vehicle is traveling in the forward direction, and the second lowered position corresponds to removal of particulate when the motorized vehicle is traveling in the reverse direction;

a blower assembly housed within the scraper blade for directing particulate removed by the scraper blade; and a chute to direct particulate toward an exterior.

2. The bi-directional snow blower of claim 1, wherein the scraper blade is movable between the first lowered position and the second lowered position by pivoting the frame, via the suspension mechanism, and thereby the scraper blade non-pivotally connected to the frame about a pivot axis.

3. The bi-directional snow blower of claim 1, wherein the scraper blade is movable between the raised position and the first lowered position by non-rotationally moving, via the suspension mechanism, the frame, and thereby the scraper blade rigidly connected to the frame in a direction generally perpendicular to the floor surface.

4. The bi-directional snow blower of claim 1, wherein the scraper blade comprises a box blade, comprising a front surface, a top surface abutting the front surface, a rear surface and a pair of side surfaces positioned laterally to the front surface, rear surface and/or the top surface, the front surface, the top surface, the rear surface and the pair of side surfaces defining an enclosure of the box blade.

5. The bi-directional snow blower of claim 4, wherein the blower assembly is housed within the enclosure of the box blade.

6. The bi-directional snow blower of claim 5, wherein the blower assembly is configured to maintain a vacuum within the enclosure of the box blade when the scraper blade is lowered into the second lowered position, and thereby fluidly isolate the enclosure of the box blade from the exterior.

7. The bi-directional snow blower of claim 4, wherein, the front surface includes an outer edge, the outer edge being positioned a first distance from the floor surface when the scraper blade is lowered into the first lowered position, the outer edge being positioned a second distance from the floor surface when the scraper blade is lowered into the second lowered position.

8. The bi-directional snow blower of claim 7, wherein the first distance is greater than the second distance.

9. The bi-directional snow blower of claim 8, wherein the second distance is about zero.

10. The bi-directional snow blower of claim 9, wherein a weight of the blower assembly is configured to exert down pressure on the scraper blade when the scraper blade is lowered into the second lowered position, the down pressure being configured to facilitate removal of compacted particulate from the floor surface.

11. The bi-directional snow blower of claim 4, wherein the rear surface of the box blade is non-perpendicular with respect to the floor surface when the scraper blade is lowered into the first lowered position or the second lowered position.

12. The bi-directional snow blower of claim 11, wherein the blower assembly is housed in a recess formed on the rear surface of the box blade.

13. The bi-directional snow blower of claim 12, wherein the rear surface forms an angle greater than 90 degrees with respect to the floor surface when the scraper blade is lowered into the first lowered position to facilitate directing particulate from the floor surface and toward the blade.

* * * * *